US006467648B1

(12) United States Patent
Nishiyama et al.

(10) Patent No.: US 6,467,648 B1
(45) Date of Patent: Oct. 22, 2002

(54) PRODUCT DELIVERING DEVICE AND PRODUCT DELIVERING METHOD OF AUTOMATIC VENDING MACHINE

(75) Inventors: Takashi Nishiyama, Saitama-ken (JP); Yoshitake Yokota, Saitama-ken (JP); Hideki Fujimoto, Saitama-ken (JP); Hiroaki Usuki, Saitama-ken (JP)

(73) Assignee: Sanyo Electric Co., Ltd., Osaka-Fu (JP)

( * ) Notice: Subject to any disclaimer, the term of this patent is extended or adjusted under 35 U.S.C. 154(b) by 73 days.

(21) Appl. No.: 09/721,707

(22) Filed: Nov. 27, 2000

(30) Foreign Application Priority Data

Nov. 26, 1999 (JP) ..... 11-336593

(51) Int. Cl.[7] ..... G07F 11/00

(52) U.S. Cl. ..... 221/7; 221/289

(58) Field of Search ..... 221/2, 7, 15, 13, 221/247, 245, 268, 289, 131, 129, 123; 700/231, 241

(56) References Cited

U.S. PATENT DOCUMENTS 6,019,246 A * 2/2000 Yajima et al. ..... 221/2
6,241,121 B1 * 6/2001 Yasaka ..... 221/226

* cited by examiner

*Primary Examiner*—Kenneth W. Noland
(74) *Attorney, Agent, or Firm*—Sughrue Mion, PLLC

(57) ABSTRACT

A stopper which projects into the product passage to support the product to be sold, an ejector which projects into the product passage to support the product to be sold next immediately after the product to be sold, and control means for controlling the projection quantity into the product passage of the stopper and the ejector, wherein the control means, upon receipt of a sales instruction, allows the ejector to project into the product passage to support the product to be sold next, opens the stopper to deliver the product to be sold from the product passage to a sales port and closes the product passage with the stopper after the delivery of the sales product while supplying the product to be sold next by recessing the ejector. As a consequence, irrespective of the size and the configuration of the product to be sold, only the product to be sold can be delivered with certitude at the time of selling the product.

17 Claims, 30 Drawing Sheets

PRODUCT DELIVERING DEVICE AND PRODUCT DELIVERING METHOD OF AUTOMATIC VENDING MACHINE

BACKGROUND OF THE INVENTION

1. Field of the Invention

The present invention relates to a product delivering device and a product delivering method of an automatic vending machine for delivering a product located at the lowest position out of a plurality of products accommodated in a product column in a downward direction at the time of selling the product in the state in which the products placed in a horizontal direction are stacked in a vertical direction.

2. Description of the Related Art

Generally, in vending machines in which products such as canned drink products, PET bottle products are accommodated in a column (a product passage) in the state in which the products placed in a horizontal direction are stacked in a vertical direction, there is provided a product delivering device for delivering the product located at the lowest position in a downward direction at the time of selling the product out of the plurality of products accommodated in the lower end portion of the column. For example, such product delivering device comprises a stopper for supporting from the lower side the product to be sold next located immediately on the product to be sold at the time of selling the product while supporting from the lower side the product to be sold, and relieving the support of the product to be sold immediately after supporting the product to be sold next, and a solenoid for driving the stopper in this manner.

The column is defined with two passage walls having mutually a space and extending in a vertical direction. The product to be sold and the product to be sold next are supported with the stopper provided on one of the passage walls and the other passage wall so that the products are held in the column. This stopper is constituted in such a manner that the stopper is projected and recessed into the column by the rotation to support the product to be sold and the product to be sold next at the time of projecting into the column while, at the same time, the distance with one of the passage walls (hereinafter referred to as a passage width) can be set at a plurality of stages. Consequently, with the product delivering device having such stopper, the passage width can be increased and decreased in accordance with the size of the products to be sold so that products having various sizes can be delivered.

In the above product delivering device, a problem in that it is troublesome to set the stopper though it is possible to deliver products having various sizes. That is, in the case where the passage width is either decreased or increased in accordance with the products to be sold, the operator who accommodates the products must manually set the stopper itself at a desired position in accordance with the size of the products to be sold. in particular, in the case where a plurality of columns are arranged in a forward and a backward direction, the operator must extend his hand deep inside of the column at the time of setting the stopper of the column at the rear side, and his work becomes very troublesome. Furthermore, in order to appropriately deliver products having approximately a square configuration, and soft PET bottle products, it is necessary to appropriately attach an adapter and the work of attaching the adapter is also troublesome. On the contrary, in the case where the adapter becomes unnecessary along with the change in the product to be sold, the adapter must be detached from the stopper, and in addition, it is also troublesome to conserve and control the adapter after the detachment.

Furthermore, in the case where products having different sizes are accommodated in one column either by error or on purpose, products having large sizes are stuck in the product delivering device when the passage width is set to the size of products having smaller size with the result that a deliver error is generated. On the other hand, in the case where the passage width is set to the size of products having larger sizes, products having smaller sizes are delivered together with products having larger sizes with the result that there is a fear that larger number of products than necessary are delivered and sold.

Furthermore, in the method for relieving the support of the products immediately after supporting the product to be sold next while supporting with the stopper the product to be sold next located immediately on the product to be sold, it is necessary to prepare stoppers having sizes and configurations which conform to the configurations of the products to be handled such as the canned drink products and PET bottle products with the result that there is a problem in that the change of the products cannot be made easily because there arises a trouble of exchanging the stopper at the time of changing the products.

SUMMARY OF THE INVENTION

The present invention has been achieved with a view of the above problem, and an object of the present invention is to provide a product delivering device and a product delivering method of an automatic vending machine, the device and the method being capable of delivering only product to be sold with certitude at the time of selling the product irrespective of the size and the configuration of the product to be sold.

According to a first aspect of the present invention, a product delivering device of an automatic vending machine comprises: a stopper which projects into a product passage to support a product to be sold; an ejector which projects into the product passage to support a product to be sold next after the product to be sold; and control means for controlling a projection quantity to the product passage of the ejector; wherein the control means allows the ejector to project into the product passage to support product to be sold next upon receipt of a sales instruction, and at the same time, opens the stopper to deliver the product to be sold from the product passage to deliver the product to be sold from the product passage to the sales port thereby closing the product passage with the stopper after the delivery of the product to be sold while supplying the product to be sold next on the stopper by allowing the ejector to be recessed.

A second aspect of the present invention provides the product delivering device of the automatic vending machine according to the first aspect wherein the ejector projects into the product passage in the projection quantity in accordance with the size of the product to be sold accommodated in the product passage.

According to a third aspect of the present invention, the product delivering device of the automatic vending machine according to the first aspect comprises: a stopper which projects into a product passage to support a product to be sold: an ejector which projects into the product passage to support a product to be sold next after the product to be sold; and drive means having a drive shaft for driving the stopper and the ejector with the movement into an axial direction on the basis of the rotation movement; wherein the drive means drives the stopper and the ejector to deliver the product to be sold to a sales port by constraining the product to be sold next after the product to be sold by the rotation of the driving shaft in a first direction, moves the stopper to the sales waiting position by rotating the driving shaft in a second direction and, at the same time, driving the stopper and the ejector so as to supply the product to be sold next to the sales waiting position from the product passage.

A fourth aspect of the invention provides the product delivering device of the automatic vending machine according to the third aspect wherein the stopper has a drive portion rotatably supported on a fixed system via a rotation shaft to receive a drive force from the drive means, and a rotation member formed of an opening and closing portion for opening and closing a product passage on the basis of the drive force.

A fifth aspect of the present invention provides the product delivering device of the automatic vending machine according to the third aspect wherein the ejector has a plate-like member which projects in an inclined manner into a product passage on the basis of the driving of the drive means, and a guide groove for guiding both ends of the plate-like member.

A sixth aspect of the present invention provides the product delivering device of the automatic vending machine according to the third aspect wherein the drive means has a drive motor which generates a rotation force for rotating the drive shaft in a first or a second direction, a first screw portion provided on the drive shaft for converting the rotation force into a to and fro movement into an axial direction of the drive shaft, a second screw portion engaging with the first screw portion and a joint portion engaged with the ejector to be supported on the drive shaft in such a manner that the joint portion can be moved to and fro.

According to a seventh aspect of the present invention, a product delivering device of an automatic vending machine for delivering a product located at the lowest position out of a plurality of products accommodated in a product passage in a downward direction at the time of selling the product in the state in which the plurality of products placed in a horizontal direction are stacked in a vertical direction, the device comprising: opening and closing means of the product passage movable between a closed position for closing the product passage so as to inhibit the delivery of the product to be sold, and an open position for opening the product passage so as to allow the delivery of the product, the means being capable of being driven toward the open position from the closed position with the weight of the product to be sold; allowing means for allowing the downward movement of the product to be sold located immediately on the product to be sold; means for supporting the product to be sold next movable between the allowing position for allowing the movement of the product to be sold next located immediately on the product to be sold and an inhibiting position for inhibiting the downward movement of the product to be sold next by supporting the product to be sold next in collaboration with the passage wall located opposite to the product passage, the inhibiting position being defined in contact with the upper a portion of the product to be sold; drive means for driving the means for supporting the product to be sold next between the inhibiting position and the allowing position; locking means for locking the product opening and closing means to the closed position; and a first unlocking means for unlocking the lock of the opening and closing means of the product passage by the locking means when the means for supporting the product to be sold next moves to the inhibiting position at the time of selling the product.

In this structure, the product to be sold is accommodated in the product passage in the state in which the delivery of the product is inhibited with the opening and closing means of the product passage locked at the above closed position with the locking means. At the time of selling the product, the means for supporting the product to be sold next moves from the allowed position to the product to be sold to come into contact with the above inhibiting position, namely, when the means for supporting the product to be sold next, the lock of the opening and closing means of the product passage means is driven from the closed position to the open position with the weight of the product to be sold with the result that the product to be sold is delivered from the product passage. on the other hand, the means for supporting the product to be sold next supports the product to be sold next in collaboration with the passage wall, so that only the product to be sold is delivered. In this case, the inhibiting position of the means for supporting the product to be sold next is defined by the product to be sold next coming into contact with the product to be sold next with the result that the inhibiting position is automatically and steplessly set in accordance with thee size and the configuration of the product. Consequently, in the above structure, only the product to be sold can be delivered at the time of selling the product irrespective of the size and the configuration of the product to be sold with the result that the flexibility of the product delivering device with respect to the product to be sold can be heightened.

An eighth aspect of the present invention provides the product delivering device of the automatic vending machine according to the seventh aspect wherein a projection portion having a height projecting to a predetermined length is provided on the passage wall, the height being approximately the same as the height at which the means for supporting the product to be sold next supports the product to be sold next.

In this structure, even when the product to be sold accommodated in the product passage has a square-shaped cross section and has four chambered corners as in the case of square-shaped bottles, the means for supporting the product to be sold next comes into contact with the chambered portion on the upper side of the product to be sold, and the two chambered portions on the lower side of the product to be sold can be supported with the means for supporting the product to be sold next and the projection portion. Consequently, with respect to not only canned drink products and PET bottle product having a circular cross section but also square-shaped PET products, only product to be sold can be delivered one by one with certitude without delivering a plurality of products at one time so that the flexability of the product delivering device can be further heightened.

A ninth aspect of the present invention provides the product delivering device of the automatic vending machine according to the seventh aspect or the eighth aspect wherein the opening and closing means of the product passage comprises: an opening and closing member which rotates on the base end portion between the closed position and the open position, the member having a long hole-like through hole extending in parallel with the rotation axial line and having a cross section extending in radial direction with respect to the center of the rotation; and a pair of guide portions provided opposite to each other with the opening and closing means located therebetween and extending in arc-like configuration centering on the rotation axis for guiding the opening and closing member between the closed position and the open position; and the locking means has a lock shaft being inserted loosely into the through hole of the opening and closing means, and, at the same time, having both end portions projecting to the outside engaging the pair of guide portions respectively, the lock shaft being slidable in a direction of the through hole when the opening and closing member is located at the closed position, an anchor portion provided respectively on the pair of guide portions so as to be projected in a radial direction with respect to the center of rotation to anchor the lock shaft, and a lock mechanism for locking the lock shaft into the anchor portion.

In this structure. the opening and closing means of the product passage rotates centering on the base end portion while being guided to the pair of guide portions via the lock shaft.

As a consequence, the opening and closing member smoothly rotates between the closed position and the open position at the time of selling the product so that the product to be sold can be delivered with certitude. Furthermore, when the opening and closing member is located at the closed position, the lock shaft anchors the anchor portion by sliding through the through hole of the opening and closing member in a long hole direction with the result that the lock shaft is locked in the anchor portion with the lock mechanism. That is, the lock shaft is double locked to the anchor portion with the lock mechanism. Thus, the detachment of the lock shaft from the anchor portion of the guide portions by the collision to the opening and closing member because of the coming down of the product at the time of refilling of the product or by tampering can be prevented with certitude and the lock of the opening and closing member at the closed position can be held with certitude.

A tenth aspect of the present invention provides the product delivering device according to the ninth aspect wherein through hole of the opening and closing member is provided on the end portion of the opening and closing member.

In this structure, since the opening and closing member can be locked at the end portion thereof via the lock shaft which is inserted into the through hole loosely, the moment acting on the opening and closing member with the weight of the product to be sold can be minimized as compared with the case in which the opening and closing member is locked at a position close to the base end portion. Thus, the opening and closing member at the closed position can be locked with certitude in a stable state.

According to an eleventh aspect of the present invention provides the product delivering device of the automatic vending machine according to the ninth or the tenth aspect wherein the lock mechanism is arranged between a pair of guide portions.

In this structure, since the lock mechanism is arranged between the pair of guide portions, the width of the product delivering device in the direction of the rotation axis of the opening and closing member, namely, the width of the product delivering device in the right and the left direction of the automatic vending machine can be reduced. As a consequence, the product delivering device can be constituted in a compact size, the device can be provided in a limited space and the width of the automatic vending machine in the right and the left direction can be reduced.

According to a twelfth aspect of the present invention provides the product delivering device of the automatic vending machine according to either the ninth aspect or the eleventh a aspect wherein the lock member comprises: a slide member attached with the lock shaft and constituted slidably between the lock position at which the lock shaft anchors the anchor portion of the pair of guide portions, and the unlock position at which the lock shaft is detached from the anchor portion; the slide member having an engaging portion; and a lock member detachably constituted in the engaging portion of the slide member to lock the slide member at the lock position by engaging the engaging portion of the slide member when the slide member is located at the lock position.

In this structure, when the slide member slidable between the lock position and the lock relief position is located at the lock position, the slide member is locked at the lock position by the engagement of the lock member into the engaging portion of the slide member. With such slide member and the lock member, the lock mechanism can be easily realized for double locking the opening and closing member located at the closed position.

A thirteenth aspect of the present invention provides the product delivering device of the automatic vending machine according to the twelfth aspect wherein the lock member is constituted rotatably between the engaging position for engaging the engaging portion of the slide member, and the detachment position for detaching from the engaging portion, and a pressing portion for sliding the slide member from the lock position to the unlock position by pressing the slide member when the lock member is rotated from the engaging position to the detachment position.

In this structure, when the lock member located at the engaging position is rotated toward the detachment position, the slide member is pressed with the pressing portion of the slide member with the result that the slide member slides from the lock position to the unlock position. Consequently, the lock shaft is detached from the anchor portion of the guide portion, so that the lock of the opening and closing member at the closed position by the lock shaft can be unlocked. Thus, with a single lock member, both the locking and the unlocking of the opening and closing member at the closed position with the lock shaft can be conducted.

A fourteenth aspect of the present invention provides the product delivering device of the automatic vending machine according to the thirteenth aspect wherein the lock mechanism has a first energizing means for energizing the lock member to be rotated from the detachment position to the engaging position, so that the lock member is rotated from the open position to the closed position by pressing the opening and closing member when the opening and closing member is located at the open position and is rotated from the detachment position to the engaging position with the first energizing means.

In this structure, the opening and closing member which is rotated from the closed position to the open position with the weight of the product to be sold is pressed against the lock member by the rotation of the lock member located at the detachment position from the detachment position from the detachment position to the engaging position with the first energizing means, so that the lock member is pressed thereby rotating the lock member from the open position to the closed position. Consequently, the opening and closing member which is rotated to the open position can be brought back to the closed position with certitude with the lock member. On the other hand, the lock of the opening and closing member at the closed position is unlocked, the energizing force of the first energizing means ceases to be transmitted to the opening and closing member because the lock member is set to the state in which the lock member is not in contact with the opening and closing member. Therefore, when the lock of the opening and closing member at the closed position is unlocked, the opening and closing member can be easily rotated with the weight of the product to be sold even when the product to be sold is light so that the product to be sold can be delivered with certitude.

A fifteenth aspect of the present invention provides the product delivering device of the automatic vending machine according to the thirteenth and the fourteenth aspect wherein means for supporting the product to be sold next has a member for supporting the product to be sold next, the member being constituted slidably between the allowing position and the inhibiting position and a connection portion having a female screw and being movable in a vertical direction for connecting the means for supporting the product to be sold next to the drive means; and the drive means has a drive source and a drive shaft having a male screw on the surface thereof which is constituted in such a manner that the drive shaft extends in a vertical direction and is movably provided in a vertical direction to be rotated and driven in a predetermined direction around an axial line with a drive source with the result that the drive shaft moves the member for supporting the product to be sold next toward the inhibiting position around an axial line with the drive source via a connection member which moves in a downward direction, and the drive shaft is further rotated and moved in a predetermined direction with the drive source after the means for supporting the product to be sold next comes into contact with the product to be sold so that the drive shaft is moved in an upward direction; wherein the first unlocking means has an unlocking member provided on the lower end of the drive shaft, and at the same time, connected to the lock member, and rotates the lock member from the engaging position to the detachment position along with an upward movement of the drive shaft.

In this structure, since the member for supporting the product to be sold next of the means for supporting the product to be sold next is connected to the drive shaft having a male screw which engages the female screw, this drive shaft is rotated and driven around the axial line with the drive source at the time of selling the product. Then, the connection member moves in a vertical direction with the result that the product to be sold next slides between the allowing position and the inhibiting position. When the drive shaft is rotated and driven in a predetermined direction at the time of selling the product, the connection member moves in a downward direction so that the member for supporting the product to be sold next slides toward the inhibiting position along with this. When the product to be sold next comes into contact with the product to be sold next, the member for supporting the product to be sold next is suspended because the member cannot be slided any more. Along with this, the connection member which has moved in a downward direction is also suspended. After the member for supporting the product to be sold next has come into contact with the product to be sold next, the drive shaft moves in an upward direction with respect to the suspended connection member. After the member for supporting the product to be sold next comes into contact with the product to be sold next, the drive shaft moves in an upward direction. Along with this, the first unlocking member provided on the lower end portion of the drive shaft is rotated toward from the engaging position to the detachment position.

Consequently, the product delivering device can be easily realized for unlocking the opening and closing means of the product passage when the means for supporting the product to be sold next comes into contact with the means for supporting the product to be sold next with the drive means and the first unlocking means.

A sixteenth aspect of the present invention provides the product delivering device of the automatic vending machine according to the fifteenth aspect where in the drive means further has a second energizing means for energizing the drive shaft in a downward direction, wherein the second energizing means is further rotated and driven in a predetermined direction with the drive force after the member for supporting the product to be sold next comes into contact with the sales product so that the second energizing means is compressed or pulled with the drive shaft which moves in an upward direction and the product to be sold is delivered with the result that the drive shaft is driven in a downward direction with a return force when the contact of the product to be sold with the member for supporting the product to be sold next is released.

In this structure, when the drive shaft is further rotated and driven in the predetermined direction after the member for supporting the product to be sold next comes into contact with the sales product to reach the inhibiting position, the drive shaft moves upward when the drive shaft is further rotated and driven in the predetermined direction with the result that the second energizing means is compressed and pulled. Then the sales product is delivered so that the drive shaft is driven downward with the return force of the second energizing means at the same time when the contact of the member for supporting the product to be sold next to the sales product is released. Then, the connection member connected to the drive shaft moves in a downward direction so that the member for supporting the product to be sold next further slides toward the side of the passage wall over the inhibition position. Consequently, for example, in the case here products having different sizes are accommodated in the product passage either by mistake or on purpose, the product to be sold next can be supported by the sliding of the member for supporting the product to be sold next toward the side of the passage wall over the inhibiting position. As a consequence, even in the above case, only the product to be sold is delivered thereby preventing the delivery and selling of larger number of products.

According to a seventeenth aspect of the present invention, the product delivering device of the automatic vending machine according to a seventh through sixteenth aspect further comprises: instruction means which is operated for instructing the delivering of all the product accommodated in the product passage at one time; and second unlocking means for unlocking the opening and closing means of the locking means.

In this structure, when the above instruction means is operated by the operator who refills the products in the automatic vending machine, the opening and closing means of the product passage by the locking means in unlocked with the second unlocking means. Consequently, in the case where a plurality of products are accommodated in the product passage, and the products are exchanged by other products, all the products accommodated in the product passage can be delivered at one time in a package by the operation of the instruction means with the result that the exchange work of the products can be conducted in a short time.

According to an eighteenth aspect of the present invention, the method for delivering the products in the vending machine comprises: accommodating product to be sold in the product passage; and delivering the product to be sold in the state in which the product to be sold next which is to be sold immediately after the product to be sold is supported in the product passage.

BRIEF DESCRIPTION OF THE DRAWINGS

FIG. 7(*b*) is a side view showing a slide member, and FIG. 7(*c*) is a side view showing a lock member, and FIG. 7(*d*) is a side sectional view showing an assemblage of these members.

DESCRIPTION OF THE PREFERRED EMBODIMENTS

Figure 1:
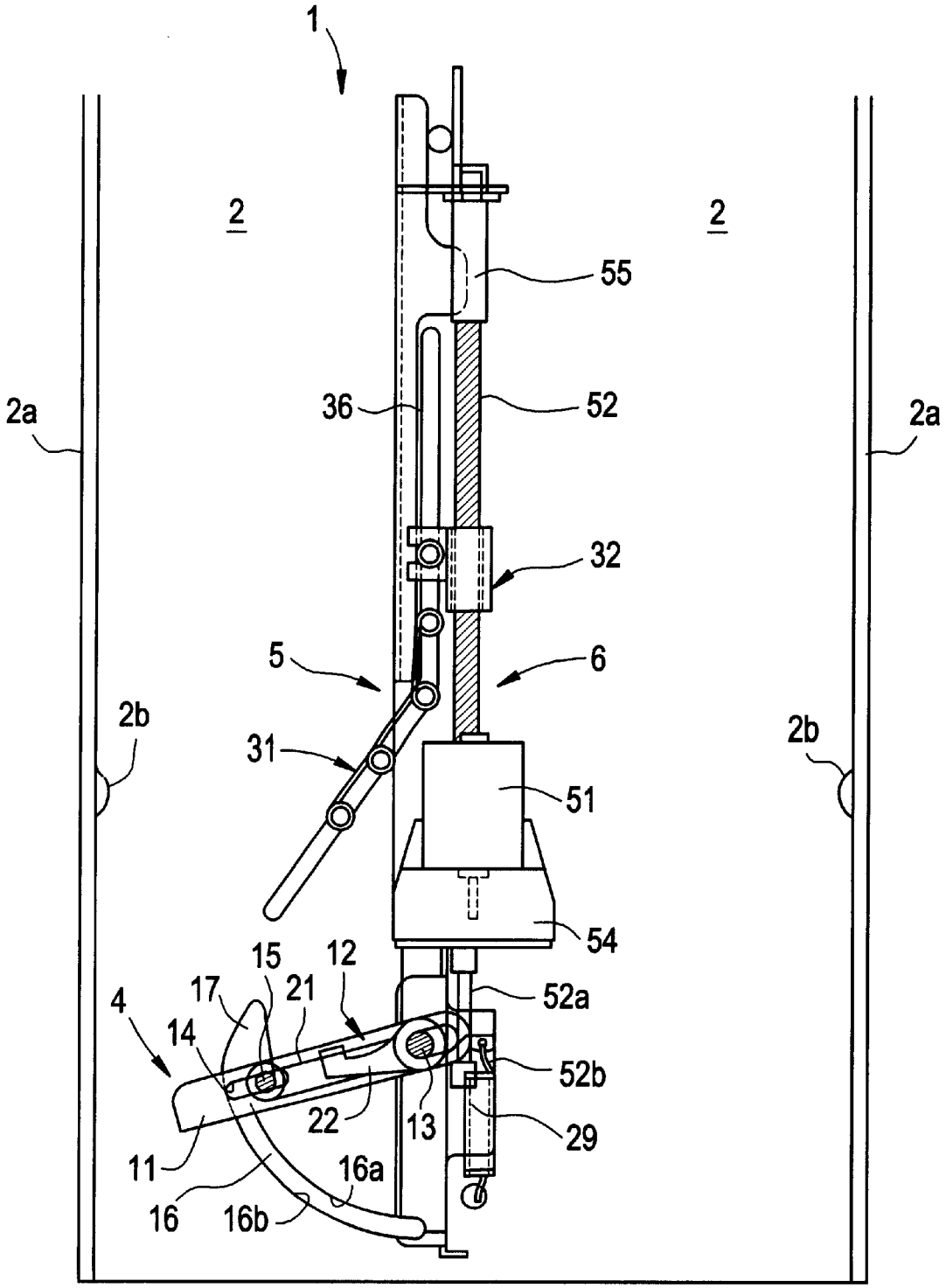
FIG. 1 is a side sectional view showing a product delivering device of an automatic vending machine according to one embodiment of the present invention.
Figure 2:
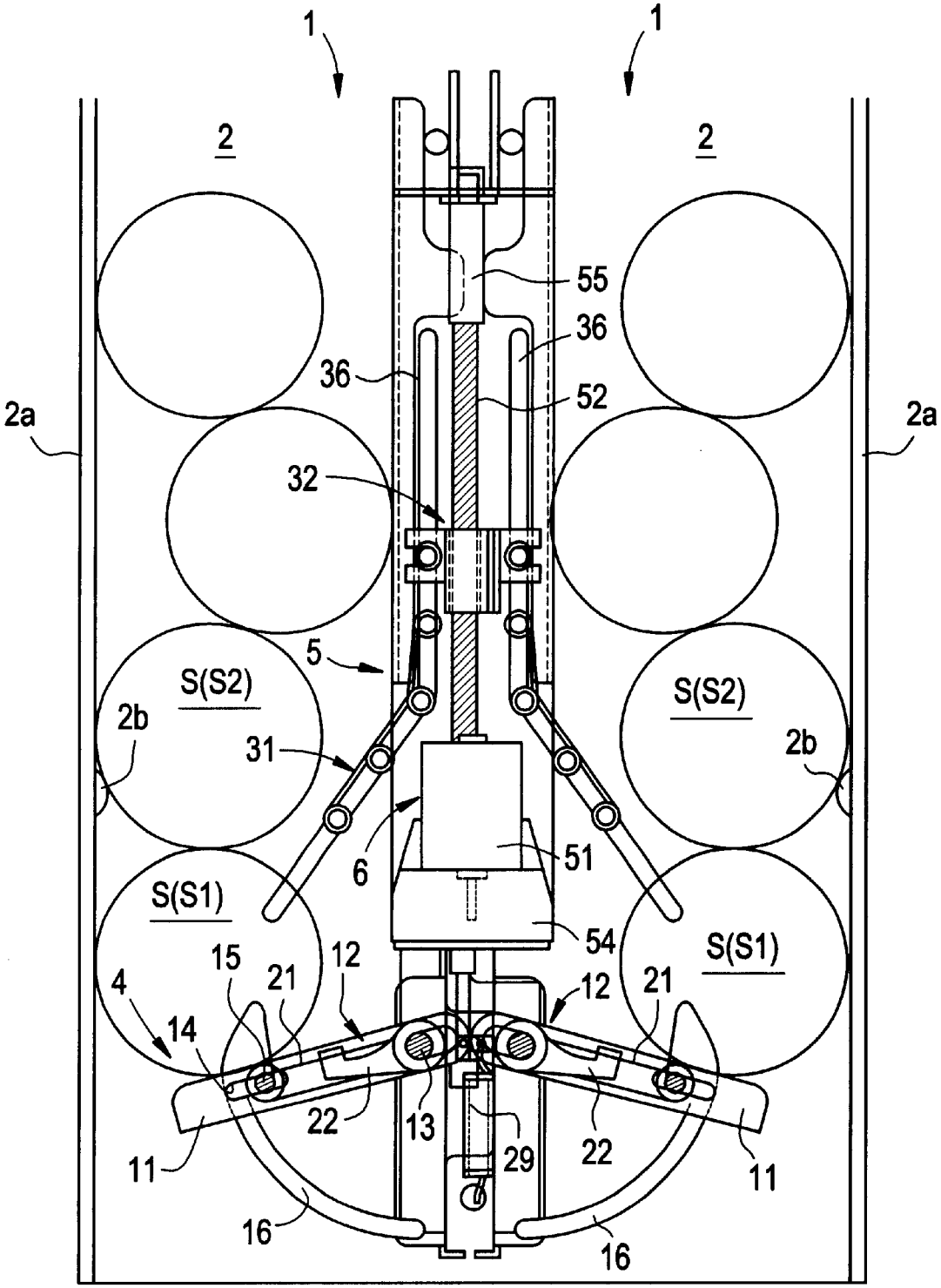
FIG. 2 is a side sectional view showing a state in which the product delivering device is arranged back to back to each other, and the products are accommodated in the product passage.

Preferred embodiments of the present invention will be explained in detail by referring to the drawings hereinafter. FIG. 1 is a view showing a product delivering device of an automatic vending machine according to one embodiment of the present invention. This product delivering device 1 is assembled in an automatic vending machine for selling, for example, canned drink products and PET bottle products so that only the product to be sold located on the lowest position is delivered in a downward direction at the time of selling the product out of a plurality of products accommodated in the state in which the products placed in a horizontal direction are stacked in a vertical direction. Furthermore, normally as shown in FIG. 2, the product delivering device 1 is arranged at the lower end portion of a partition wall (not shown) of two product passages 2 and 2 located at the front and the rear position extending in the vertical directions (in the right and the left direction in FIG. 2) in the state in which the two product passages are located back to back to each other. At the time of selling the product, each of the product delivering devices 1 is independently operated to deliver the product S to be sold in each of the product passages. Incidentally, in the forgoing explanation, the products to be sold next located immediately on the product to be sold are respectively denoted by reference numerals S1 and S2 out of the product S accommodated in the product passage 2.

Figure 3:
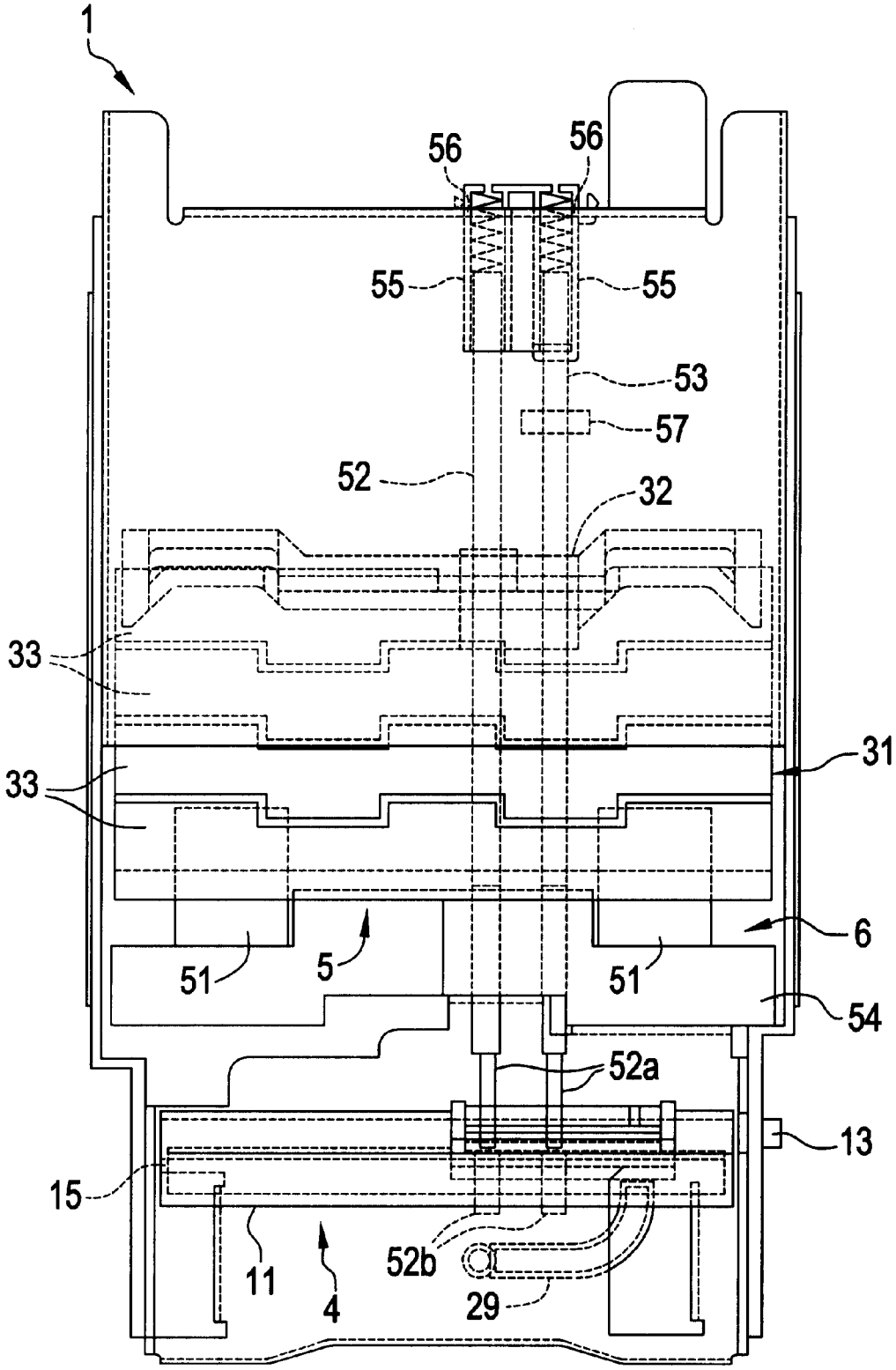
FIG. 3 is a front view showing the product delivering device.
Figure 4:
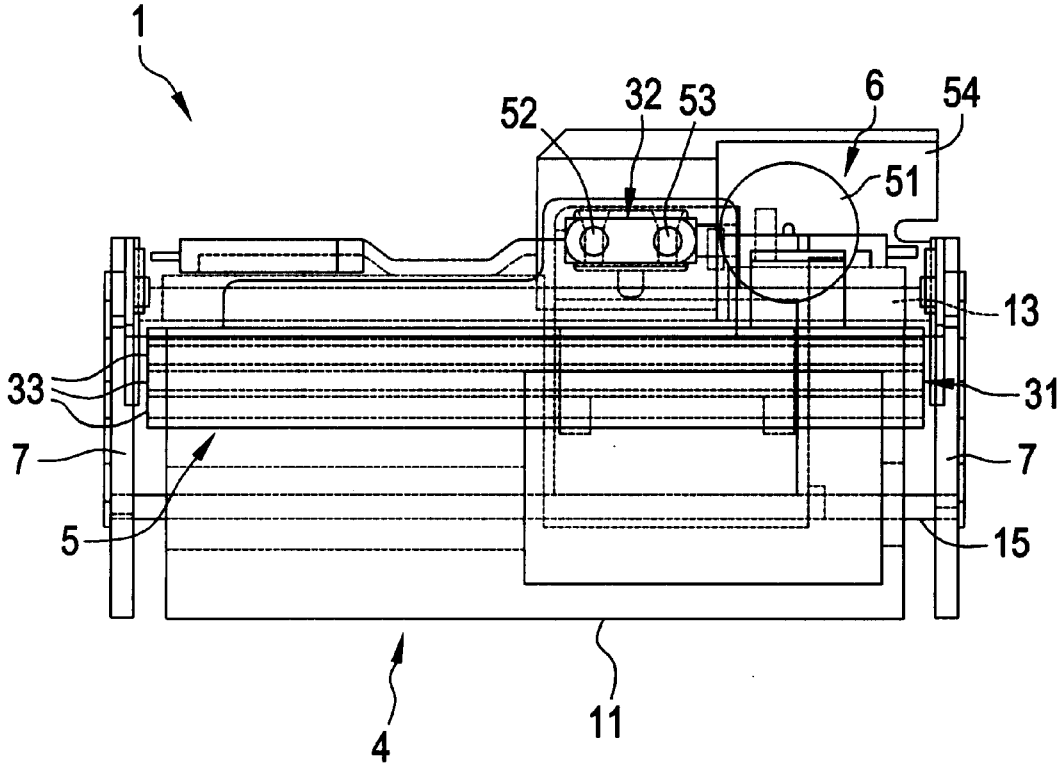
FIG. 4 is a plan view showing the product delivering device.
Figure 5:
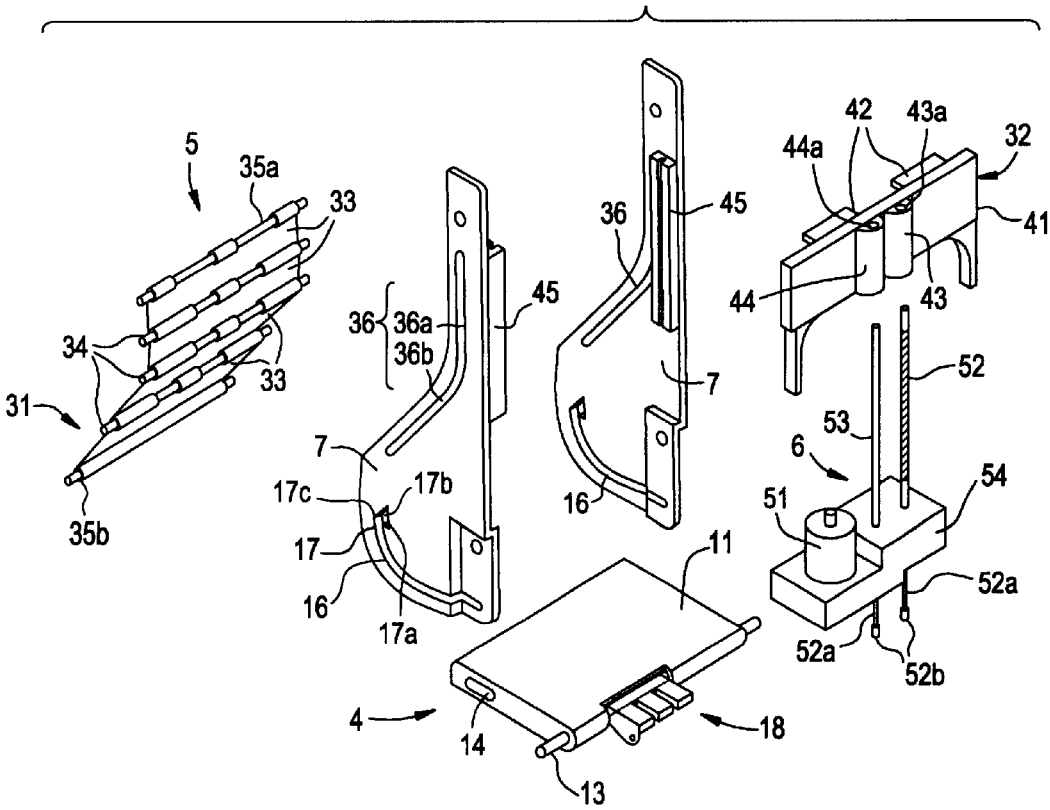
FIG. 5 is a broken perspective view showing the product delivering device.

The product delivering device 1, as shown in FIGS. 1 through 5, comprises: a stopper 4 opening and closing means of a product passage) for delivering in a downward direction the product S1 to be sold by allowing the product to be sold accommodated in the product passage 2 to come down by opening and closing the lower end portion. of the product passage 2 at the time of selling the product; an ejector 5 (means for supporting the product to be sold next) for supporting the product to be sold next in collaboration with the wall of the passage 2*a* projecting to the product passage and located opposite to the product passage 2; wherein the stopper 4 and the ejector 5 are assembled between the pair of side plates 7 and 7 having a predetermined configuration located opposite to each other in the right and the left direction as shown in FIGS. 4 and 5.

The stopper 4 comprises a thick plate having a planar configuration formed approximately in a square configuration, and the stopper 4 has a main body 11 (an opening and closing member) which is rotatable around the base end portion. The main body 11 of the stopper is locked to the closed position described later with the locking means 12 assembled in the main body of the stopper.

Figure 13:
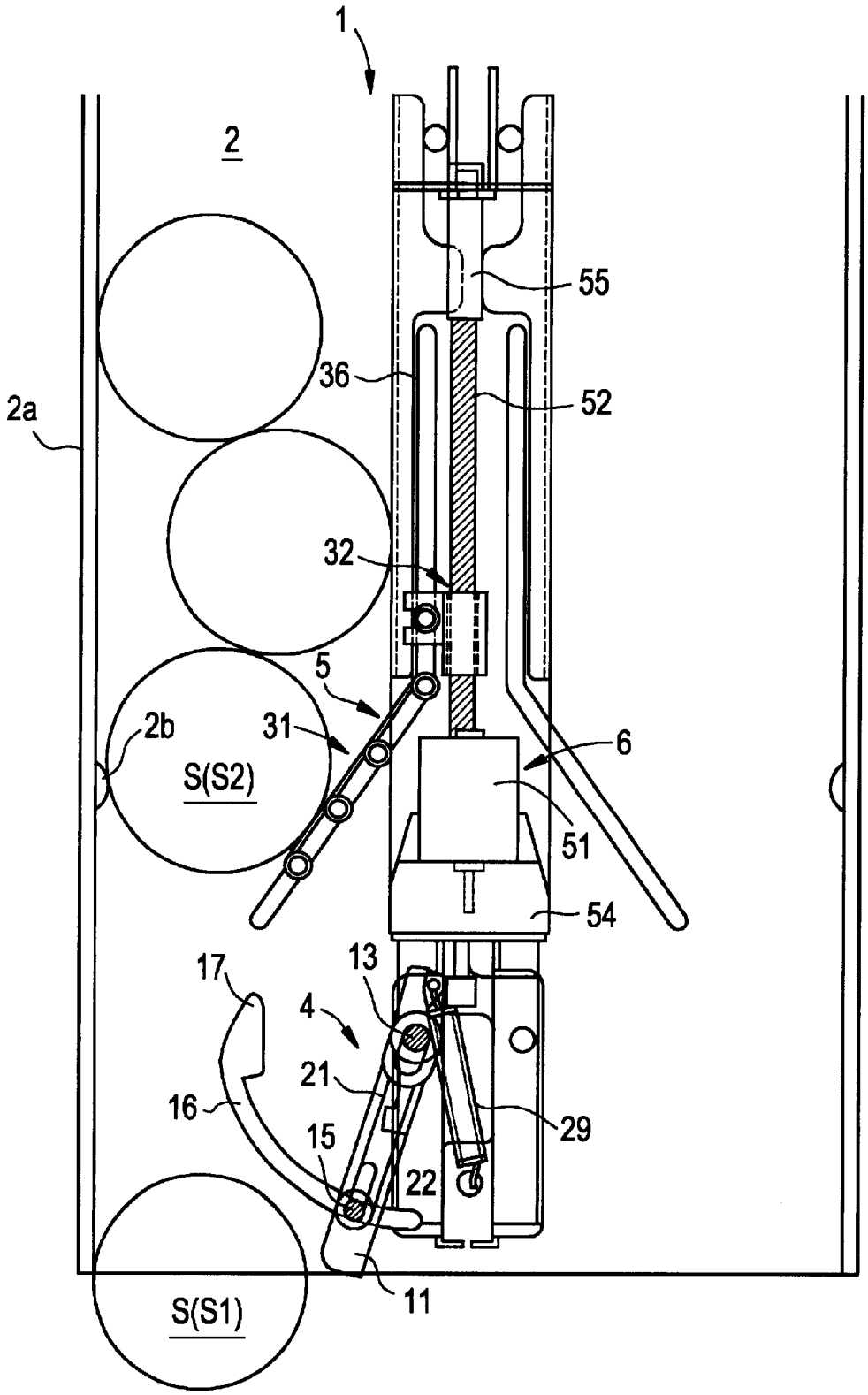
FIG. 13 is a side sectional view following FIG. 12 and shoring a product delivering device, the view showing the state in which the main body of the stopper reaches the open position, and the product to be sold is delivered.
Figure 21:
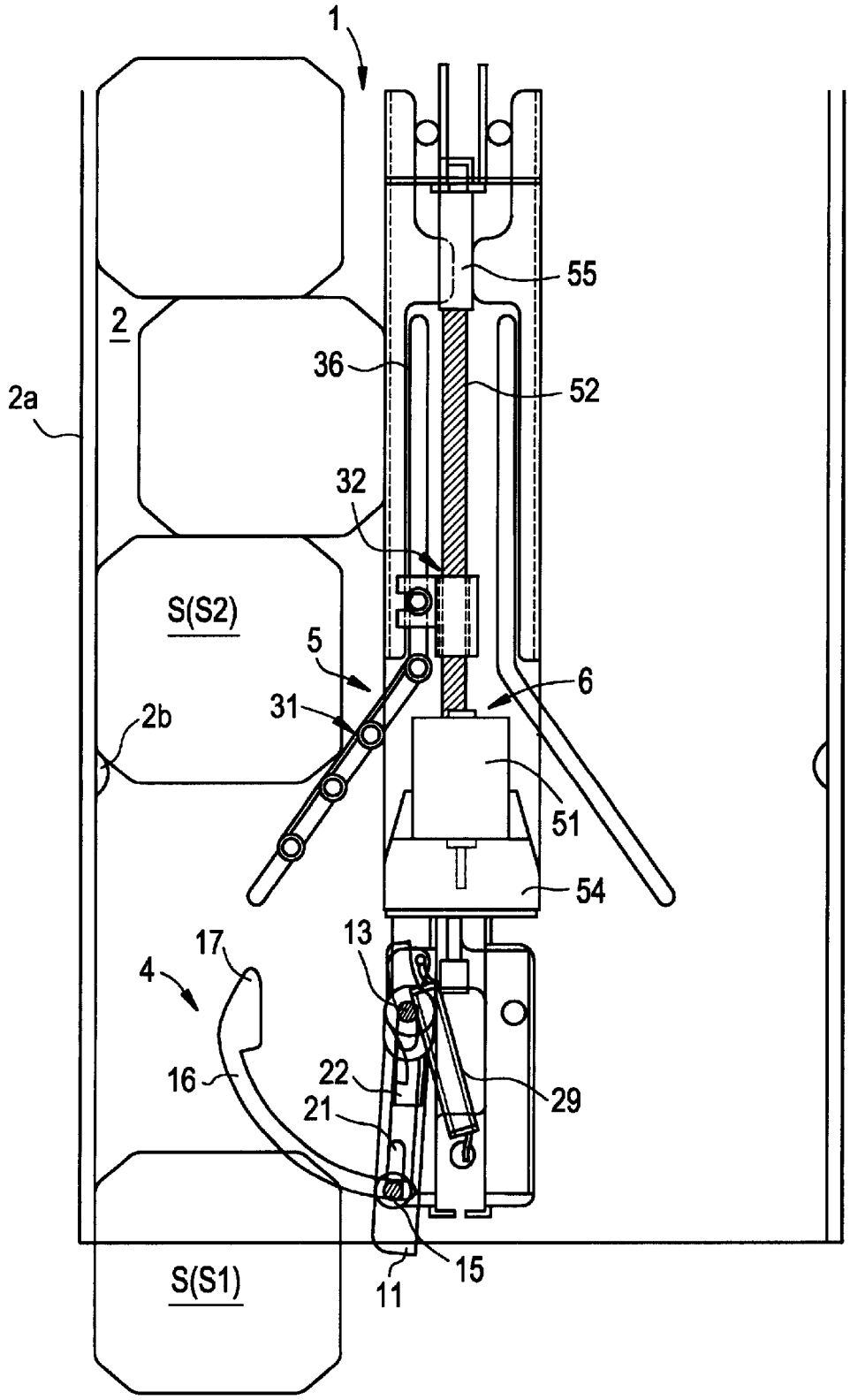
FIG. 21 is a side sectional view following FIG. 20 and showing the product delivering device, the view showing the state in which the main body of the stopper reaches the open position, and the product to be sold is delivered.
Figure 22:
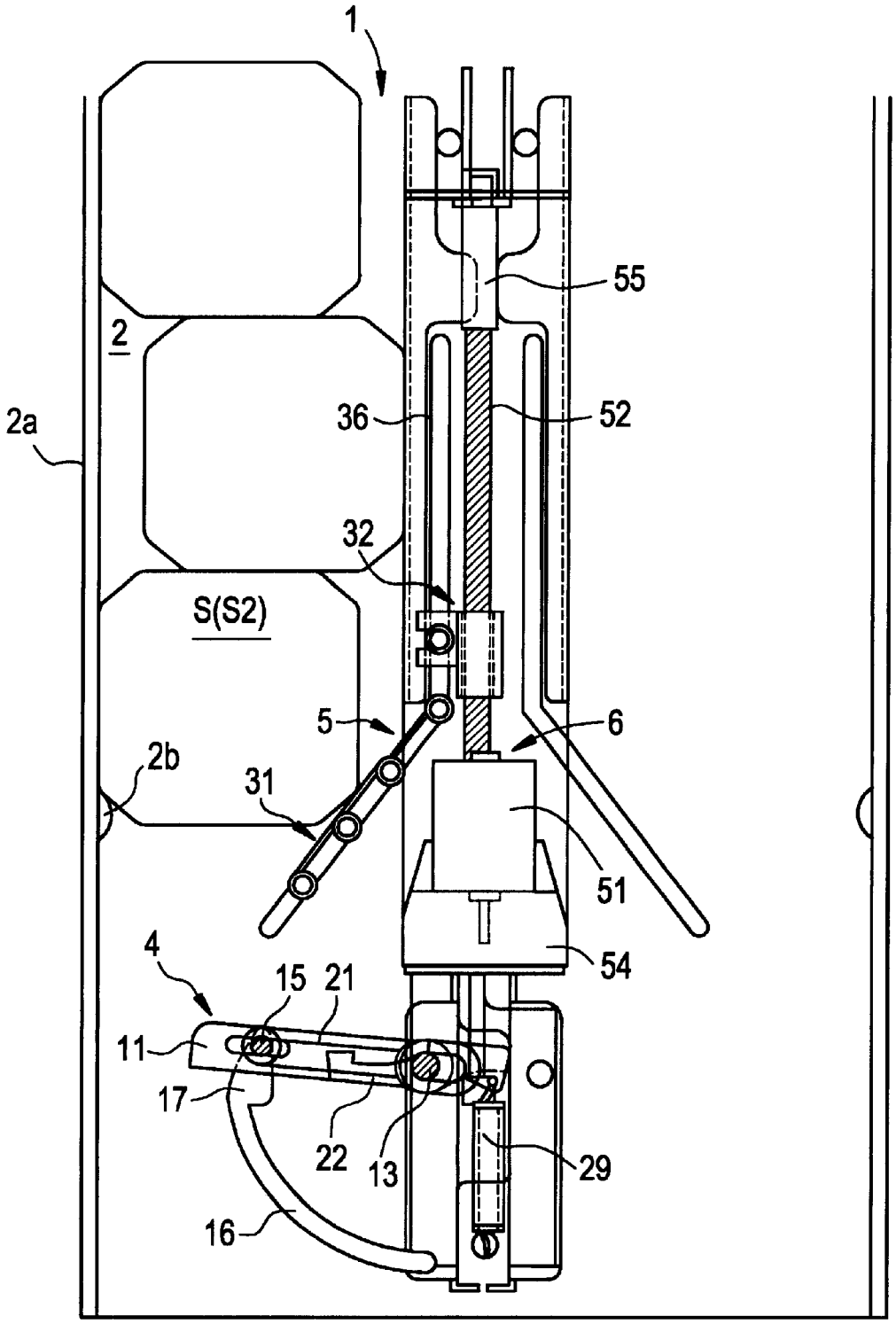
FIG. 22 is a side sectional view following FIG. 21 and showing the product delivering device, the view showing the state in which the upper end is rotated to the guide groove.
Figure 23:
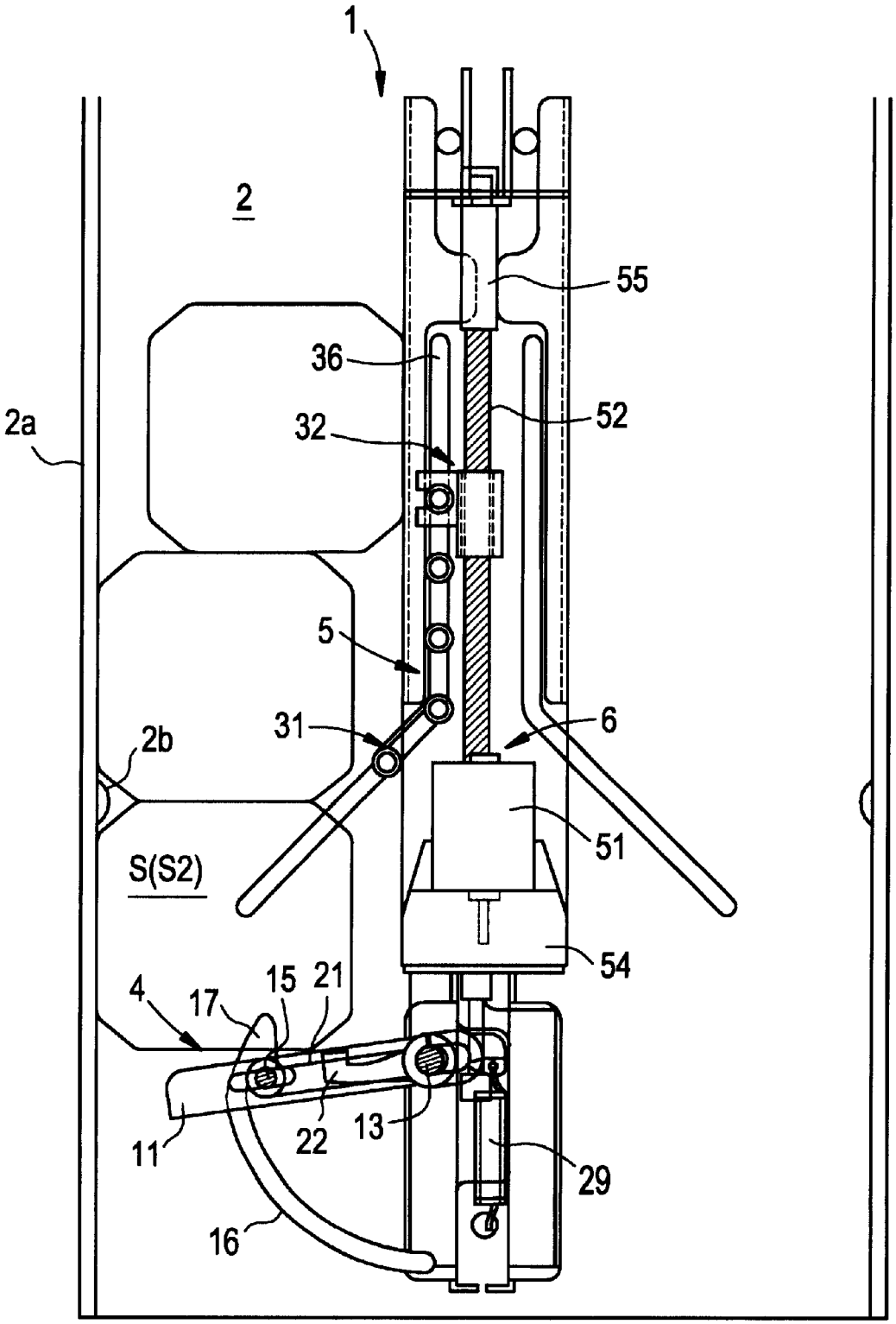
FIG. 23 is a side sectional view following FIG. 22 and showing the product delivering device, the view showing the state in which the main body of the stopper is rotated to the closed position and locked by the coming down of the product to be sold next which is supported by the main body of the ejector.
Figure 28:
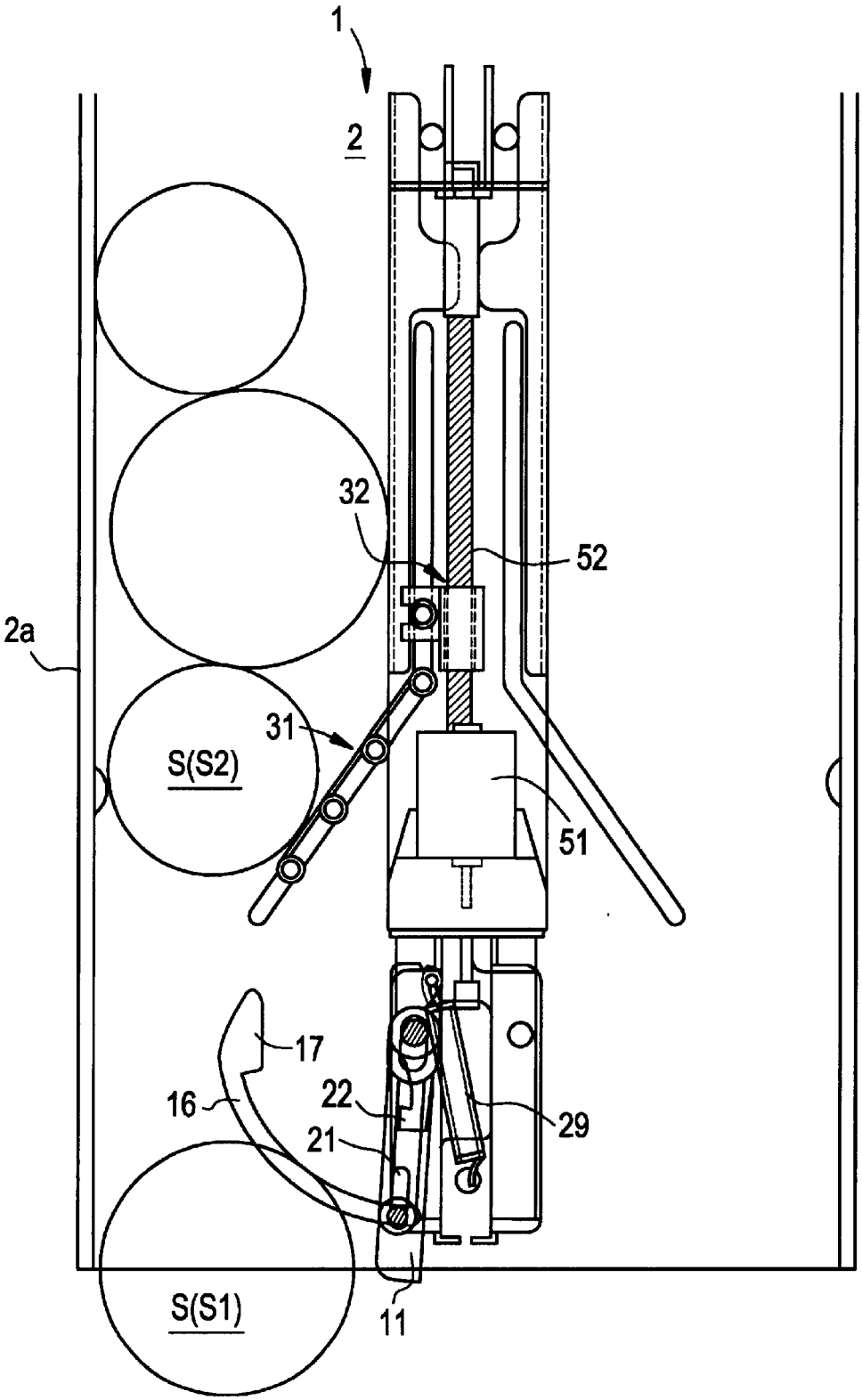
FIG. 28 is a side sectional view following FIG. 27 and showing the side sectional view of the product delivering device, the view showing the state in which the main body of the stopper reaches the open position and thick canned product to be sold is delivered.
Figure 29:
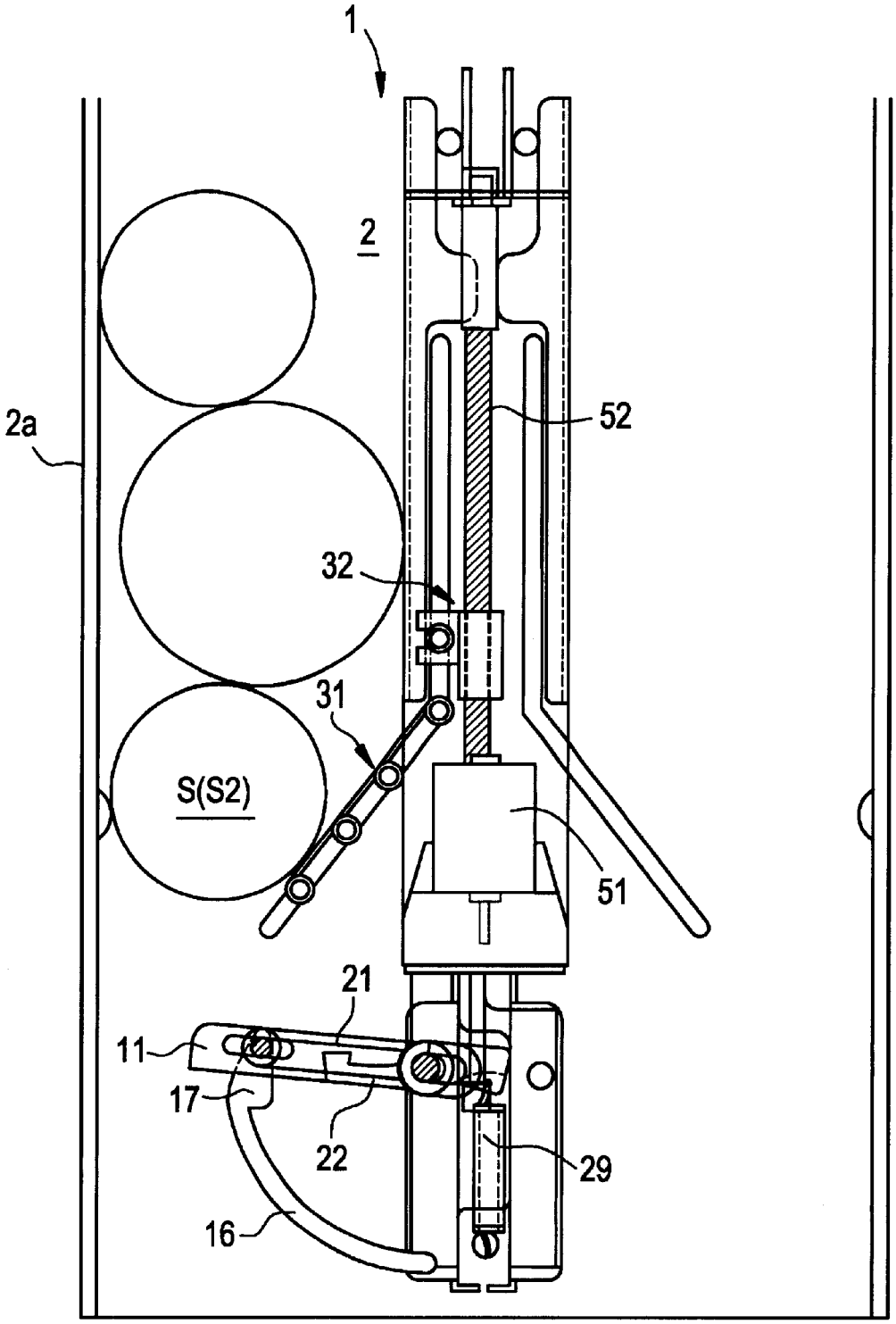
FIG. 29 is a side sectional view following FIG. 28 and showing the product delivering device, the view showing the state in which main body of the stopper is rotated to the upper limit position of the guide groove.
Figure 30:
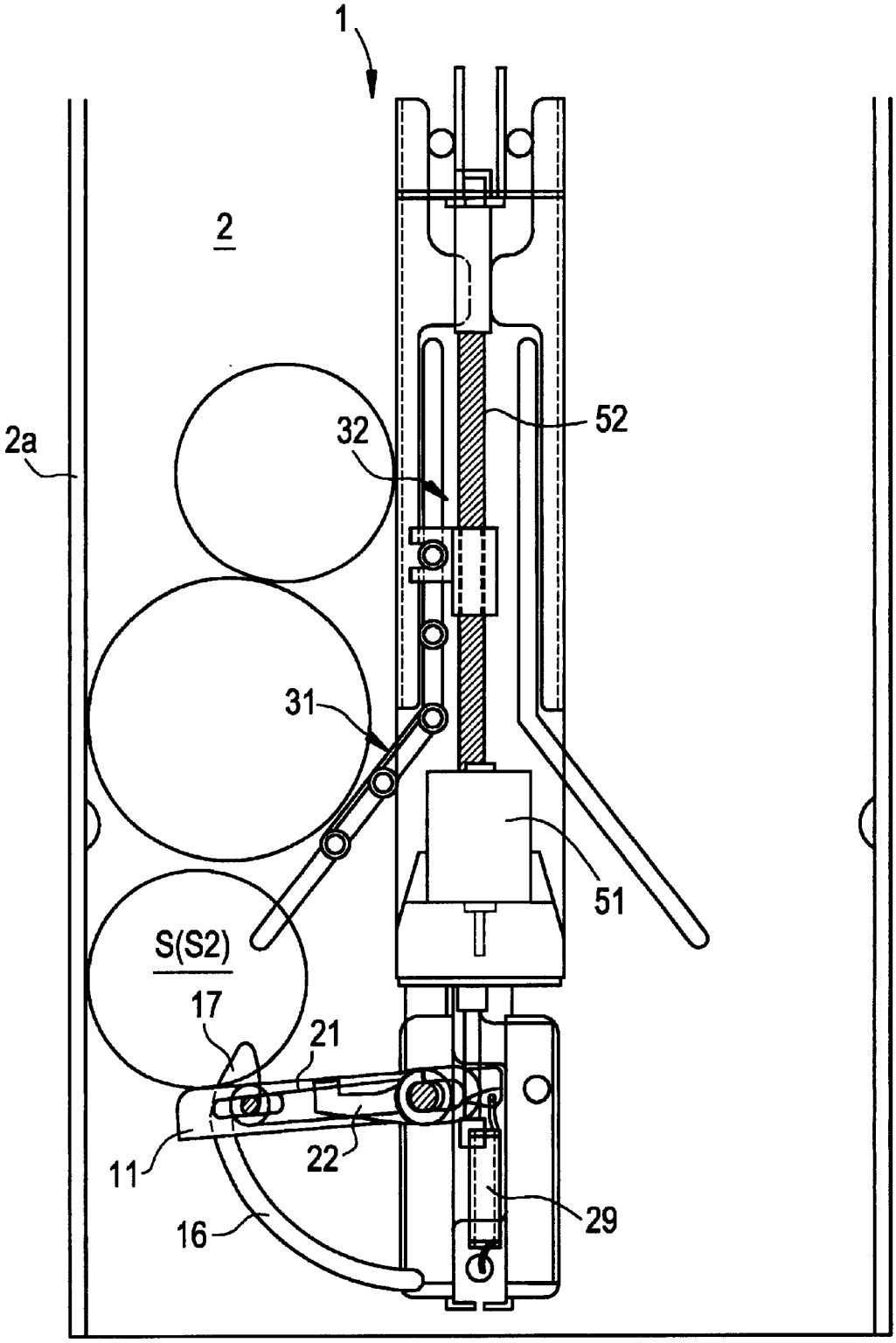
FIG. 30 is a side sectional view following FIG. 29 and showing the state in which the main body of the stopper is rotated to the closed position and is locked by the coming down of the product to be sold next supported on the main body of the ejector onto the main body of the stopper.

The main body 11 of the stopper is rotatably attached on the side plate via the rotation shaft 13 attached on the base end portion. The main body 11 of the stopper is rotatably attached on the side plates 7 and 7 via the rotation shaft 13 attached on the base end portion so that the main body 11 of the stopper can be rotated between the closed position (see FIG. 1 and the like) for closing the product passage 2 so as to inhibit the delivery of the product to be sold at the time of selling the product and the open position (see FIGS. 13, 21 and 28) for opening the product passage 2 so as to allow the delivery of the product S1 to be sold at the time of selling the product. Furthermore, at a position close to the end portion of the main body 11 of the stopper, there is provided a long hole-like through hole 14 extending in parallel with the axial line (hereinafter referred to as the rotation axial line) of the rotation shaft 13 and having a cross section extending in a radial direction with respect to the center of the rotation, Into this through hole 14, the lock shaft 15 is inserted loosely for locking the main body 11 of the stopper at the closed position. The lock shaft 15 is constituted in such a manner that the shaft 15 can be slided in a direction of the long hole of the through hole 14, and both ends of the lock shaft 15 projecting to the outside from the through hole 14 are inserted loosely into the guide groove 16 (the guide portion) having a predetermined configuration which is formed on each of the side plates 7. Each of the guide grooves 16 is formed so as to extend in an approximately ¼ arc-like configuration. At the upper end thereof, a shaft anchor groove 17 is formed for guiding the lock shaft 15 to allow the lock shaft 15 to be slided and anchored to the base end portion of the main body 11 of the stopper.

The main body 11 of the stopper constituted in this manner is smoothly rotated between the closed position and the open position while being guided to both guide grooves 16 and 16 via the lock shaft 15. The lock shaft 15 is locked with certitude to the closed position by the anchoring of the lock shaft 17 to each of the anchor groove 16 of the lock shaft.

As described above, the locking means is provided for locking the main body 11 of the stopper to the closed position, and the main body 11 of the stopper comprises the lock shaft 15, the shaft anchor groove 17 and a lock mechanism 18 assembled in the main body 11 of the stopper for locking the lock shaft 15 to the shaft anchor groove 17. As shown in FIG. 5 or 8(*a*), the shaft anchor groove 17 is formed approximately in a right angle triangular configuration with an anchor portion connected to the inside guide surface 16*a* of the guide groove 16 to project horizontally toward the side of the rotation shaft 13, a vertical guide portion 17*b* connected to the end of the anchor portion 17*a* and extending approximately vertically upward, and an inclined guide portion 17*c* connected in an inclined manner to the upper end of the vertical guide portion 17*b* and the outside guide surface 16*b* of the guide groove 16. When the main body 11 of the stopper is rotated from the open position toward the closed position, the lock shaft 15 is guided with the inclined guide portion 17*b* to be anchored to the anchor portion 17*a* so that the main body 11 of the stopper is locked to the closed position.

Figure 6:
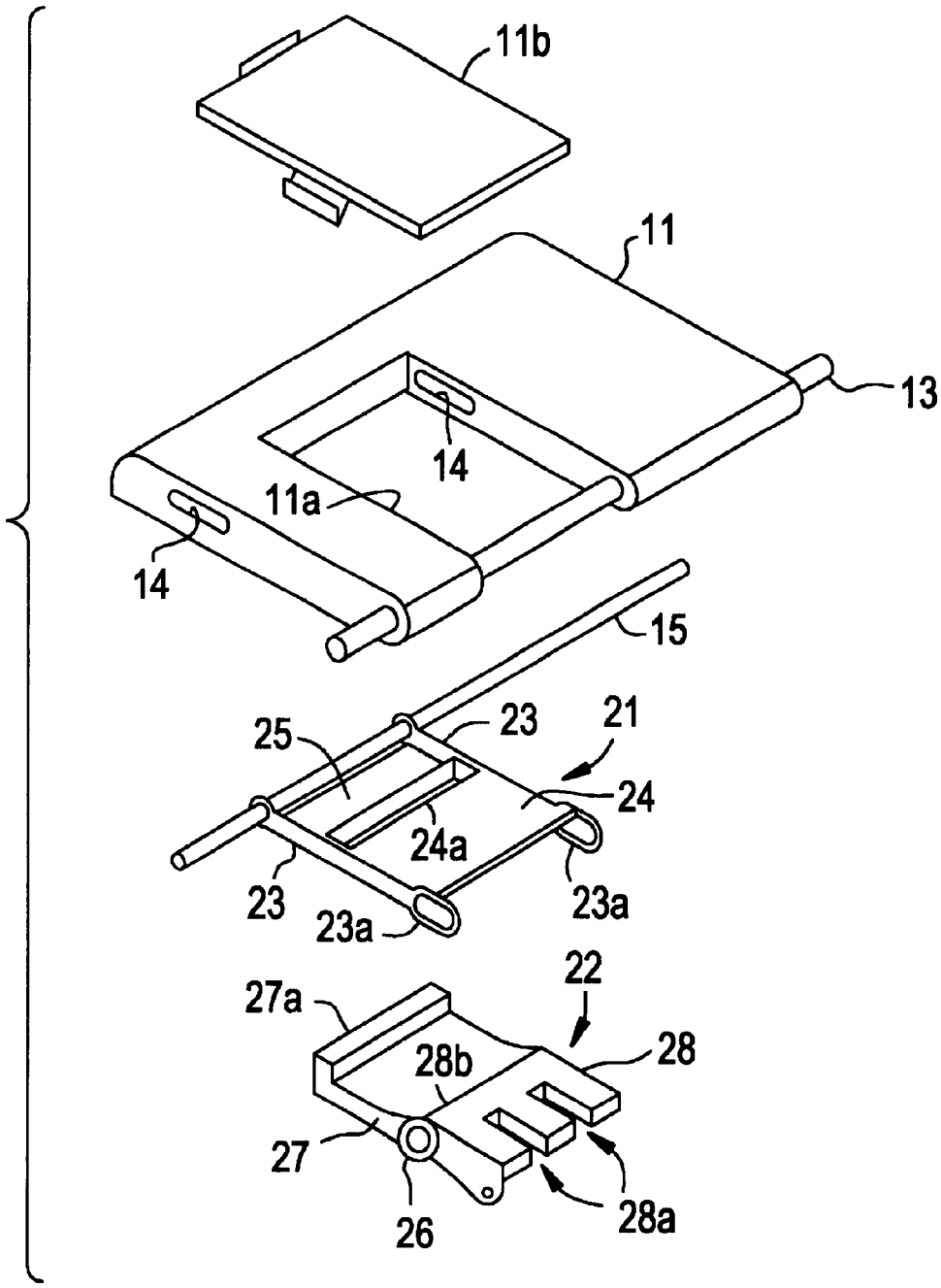
FIG. 6 is a broken perspective view showing a main body of the stopper.
Figure 7A:
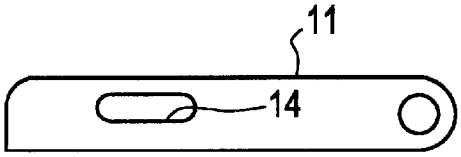
FIG. 7(*a*) is a side view showing them main body of the stopper.
Figure 7B:
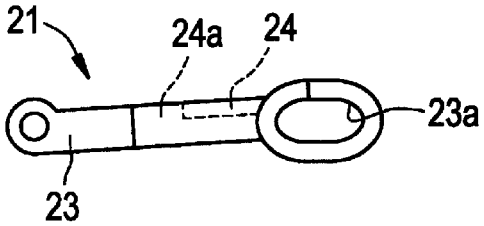
Figure 7C:
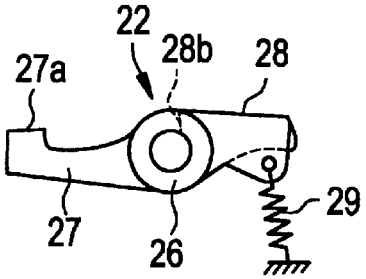
Figure 7D:
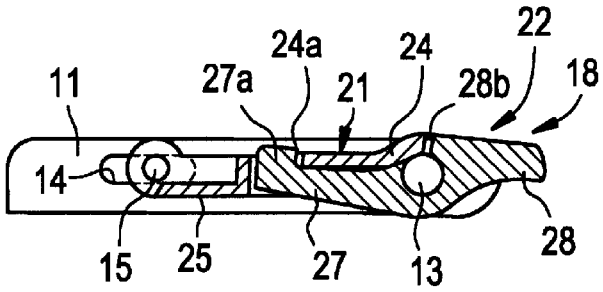
Figure 8A:
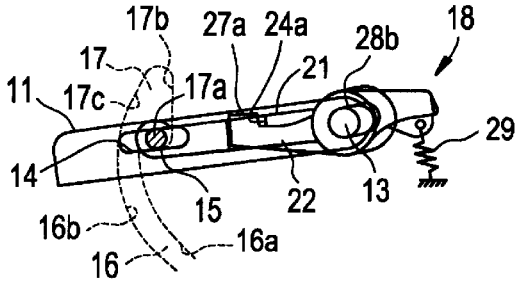
FIG. 8 is a side sectional view showing a series of an operation from the unlocking of the main member of the stopper which is locked until relocking of the main body of the stopper.
Figure 8E:
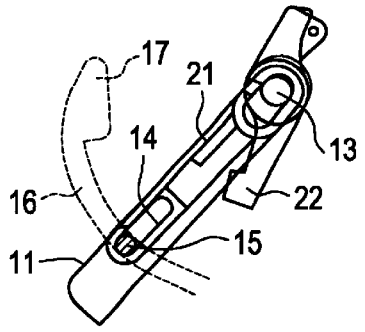
Figure 8B:
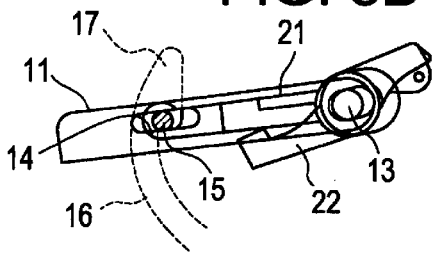
Figure 8F:
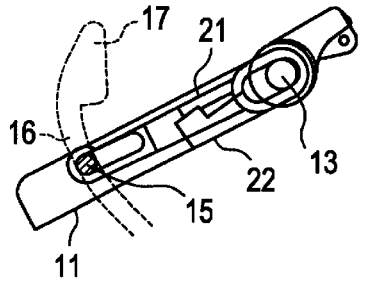
Figure 8C:
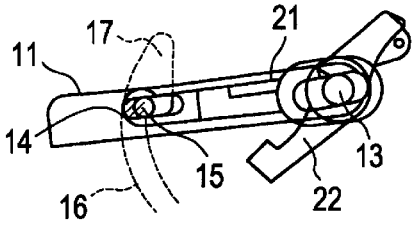
Figure 8G:
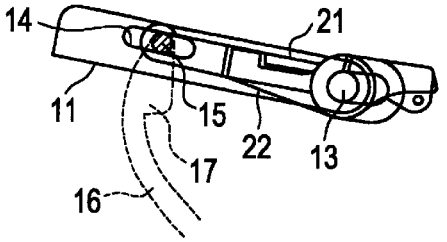
Figure 8D:
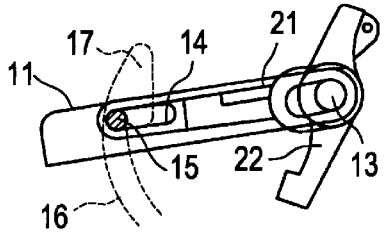
Figure 8H:
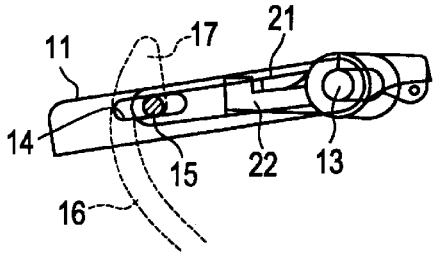

As shown in FIG. 6 and FIG. 7, the lock mechanism 18 is accommodated in the planar opening 11*a* having approximately a square configuration of the main body 11 of the stopper, and has a slide member 21 slidable between the lock position and the unlock position described later, and a lock member 22 for locking the slide member 21 to the lock position and allowing the slide member 21 to slide toward the unlock position at the time of selling the product.

The slide member 21 has a pair of side wall portions 23 and 23 extending in parallel to each other with a space mutually to each other, an upper wall portion 24 connecting approximately horizontally between the upper end portions of the side wall portions 23 and 23, and a lower wall portion 25 connecting between the lower end portions of the side wall portions 23 and 23. On the end portion of the side wall portions 23 and 23, the lock shaft 15 is penetrated and provided, and at the same time, on the base end portion on the opposite side, long holes 23*a* and 23*a* are formed which extends in the extending direction of the side wall portions. The upper wall portions 24 are formed in an upward direction of the long holes 23*a*, and is formed to extend in a predetermined length toward the end portion of the slide member 21 approximately from the intermediate portion in the long hole direction of the long holes 23*a* and 23*a*. Furthermore, on the end of the upper wall portion 24, an open engaging portion 24*a* to which the engaging projection portion 27*a* of the lock member 22 described later is formed. On the other hand, the lower wall portion 25 is constituted in such a manner that the lower end portion extends in a downward direction from the end of the upper wall portion 24 and is bent at right angle to extend toward the end portion of the slide member 21.

The slide member 21 which is constituted in this manner is such that the lock shaft 15 at the end portion is inserted loosely into the through hole of the main body 11 of the stopper, and the rotation shaft 13 is inserted loosely into the long holes 23*a* and 23*a* of the base end portion in the state in which the slide member 21 is accommodated in the opening 11*a* of the main body 11 of the stopper as shown in FIG. 7(*d*). Then, the slide member 21 can be slided between the lock position (see FIG. 8(*a*)) at which the lock shaft 15 anchors the anchor portion 17*a* of the shaft anchor groove 17 and the unlock position (see FIG. 8(*d*)) at which the lock shaft 15 is detached from the anchor portion 17*a*.

On the other hand, the lock member 22 has a hole portion 26 in which the rotation shaft 13 can be inserted loosely, a lock portion 27 in which the end portion (hereinafter referred to as an engaging projection portion) 27*a* and a connection portion 28 extending in a direction opposite to the lock portion 27 with a hole portion 26 therebetween, and connecting to a drive shaft 52 of the drive mechanism 6 described later and delivery shaft 53. This lock member 22 becomes rotatable between the engagement position (see FIG. 7(*d*) and FIG. 8(*a*)) at which the engaging projection portion 24*a* of the lock member 22 engages the engaging portion 24*a* from the lower side and the detachment position at which the projection portion 27*a* of the lock member 22 is detached from the engaging portion 24*a* by allowing the lock member 22 to be assembled into the main body 11 of the stopper in the state in which the rotation shaft 13 is inserted loosely into the hole portion 28. On the connection portion 28, two notches 28*a* and 28*a* are formed which extend in parallel with each other toward the hole portion 26. The lower end portions of the drive shaft 52 and the delivery shaft 53 are inserted loosely respectively into these notches 28*a* and 28*a*.

Furthermore, the notches 26*a* and 28*a* of the connection portion 28 and the end portion 28*b* (pressed portion) on the opposite side are formed at a position one step higher than the lock portion 27. Consequently, in addition to the slide member 21, the lock member 22 is assembled in the main body 11 of the stopper. When the lock member 22 is positioned at the engaging position, as shown in FIG. 7(*d*), the end portion 28*b* of the connection portion 28 comes close to the end portion of the upper wall portion 24 of the slide member 21. Furthermore, on the side portion of the connection portion 28, a pull spring 29 (a first energizing means) is attached on the side portion of the connection portion 28. This pull spring 29 is energized so as to rotate the lock member 22 in a clockwise direction in FIG. 7. With this pull spring 29, the lock member 22 is set to the state in which the lock member 22 is energized to the engaging position at all times.

The lock member 22 constituted in this manner is rotated to the detachment position from the engaging position in a counterclockwise direction in FIG. 7 by the pulling up of the connection portion 28 either with the drive shaft 52 or the delivery shaft 53.

Incidentally, on the main body 11 of the stopper, an upper lid 11*b* for opening and closing the opening 11*a* is detachably attached. When the upper lid 11*b* is attached thereon, the upper lid 11*b* and the main body 11 of the stopper form one surface.

Here, by referring to FIG. 8, the locking and unlocking of the main body 11 of the stopper by the locking means will be explained. As shown in FIG. 8(*a*), the slide member 21 is located at the lock position at the sales waiting time so as to lock the slide member 21 to the lock position. In this case, the lock shaft 15 of the slide member 21 is supported to the anchor portion 17*a* from the lower side with the result that the main body 11 of the stopper is locked to the closed position in the state in which the product to be sold is supported from the lower side.

In this state, when the connection portion 28 of the lock member 22 is pulled up either with the connection portion 28 or a drive shaft 52, the lock member 22 is rotated in a counterclockwise direction toward the detachment position against the pull spring 29. Thus, as shown in FIG. 8(*b*), the engaging projection portion 27*a* of the lock member 22 is detached from the engaging portion 24*a* of the slide member 21, and, at the same time, the end portion 28*b* of the connection portion 28 of the lock member 22 presses the end portion of the upper wall portion 24 of the 24 of the slide member toward the end of the main body 11 of the stopper. Then, the slide member 21 at the lock position gradually slides toward the unlock position. When the lock member 22 further rotates to press the slide member 21 and the slide member 21 reaches the unlock position as shown in FIG. 8(*d*), the lock shaft 15 is completely detached from the anchor portion 17*a* of the shaft anchor groove 17. Then, as shown in FIG. 8(*b*), the main body 11 of the stopper is rotated and driven toward the open position while being guided with the guide groove 16 via the lock shaft 15. When the main body 11 of the stopper reaches the open position, the product S1 to be sold comes down and is delivered from the product passage.

After that, when the drive shaft 52 or the delivery shaft 53 which pulls up the connection portion 28 of the lock member 22 releases the pull-up of the connection portion 28, the lock member 22 is rotated and driven in the clockwise direction with the return force of the pull spring 29. Then, the engaging projection portion 27*a* of the lock member 22 presses up the upper wall portion 24 of the slide member 21 from the lower side with the result that, as shown in FIG. 8(*f*). the main body 11 of the stopper is rotated in a clockwise direction toward the closed position.

When the lock member 22 is further rotated in the clockwise direction, the main body 11 of the stopper is also rotated in a clockwise direction, the main body 11 of the stopper is also rotated in a clockwise direction so that the lock shaft 15 reaches the upper end portion of the shaft anchor groove 17 while being guided with the inclined guide portion 17*c* of the shaft anchor groove 17 along the inclined guide portion 17*c*. Then, at the position shown in FIG. 8(*g*), the main body 11 of the stopper is suspended. In this case, the lock shaft 15 is guided with the inclined guide portion 17*c* so that the lock shaft 15 slides toward the side of the base end portion so that the slide member 21 slides toward the lock position. Then, the engaging projection portion 27*a* of the lock member 22 engages the engaging portion 24*a* of the slide member 21 that has slided to the lock position.

Thereafter, when the product S2 to be sold next moves in a downward direction and comes down onto the main body 11 of the stopper, the main body 11 of the stopper is rotated in the counterclockwise direction with the weight of the product S2 itself. In this case, the lock shaft 15 is guided in a downward directions with the vertical guide portion 17*b* to be anchored to the anchor portion 17*a*. As a consequence, as shown in FIG. 8(*h*) or FIG. 8(*a*), the main body 11 of the stopper is locked to the closed position.

As described above, the main body 11 of the stopper locked to the lock position via the lock shaft 15, and at the same time, this lock shaft 15 is locked to the lock position with the slide member 21 and the lock member 22 so that the lock shaft 15 is double locked. As a consequence, the detachment of the lock shaft 15 from the anchor portion 17*a* of the shaft anchor groove 17 by the collision to the main body 11 of the stopper due to coming down of the product S at the time of refilling of the product and by tampering can be prevented with the result that the lock of the main body 11 at the closed position can be held with certitude. Furthermore, the slide member 21 can be locked at the lock position with the lock member, and at the same time, the slide member is slided to the unlock position by the rotation of the lock member 22 with the result that the locking and unlocking of the main body 11 of the stopper with the lock shaft 15 can be both facilitated with lock member 22 having a simple structure.

Next, an ejector 5 above the main body 11 of the stopper will be explained which ejector is arranged between the side plates 7 and 7 to support the product S2 to be sold next in collaboration with the passage wall 2*a*. The ejector 5 is constituted so as to move in a vertical direction and in an downwardly inclined direction toward to the front, and the ejector 5 has a main body 31 of the ejector (a member for supporting the product to be sold next) and a joint 32 (a connection member) for connecting the main body 31 of the ejector to the drive mechanism 6.

As shown in FIG. 5, the main body 11 of the ejector comprises four ejector plates 33 formed in a vertically long square configuration, three connection shafts 34 rotatably connecting the four ejector plates in a vertical state, an upper shaft 35*a* and a lower shaft 35*b* respectively attached on the upper end portion of the ejector plate 33 located at the upper most position and the lower end portion of the ejector plate 33 located at the lowermost position, the upper shaft and the lower shaft being constituted in the same manner as these connection shaft 34. Both end portions of each of the connection shaft 34, the upper shaft 35*a* and the lower shaft 35*b* are inserted loosely into the ejector guide groove 36 formed respectively on the both side plates 7 and 7. Each of the ejector guide grooves 36 is formed in a bent configuration with a vertical guide groove 36*a* which extends vertically, and an inclined guide groove 36*b* connecting from the lower end of the vertical guide groove 36*a*, being inclined in a forward direction and extending toward the product to be sold S1. Incidentally, the inclined guide groove 36*b* of each of the ejector guide grooves 36 is extended so as to come close to the passage wall 2*a* rather than to the end portion on the side opposite to the passage wall 2*a* of the product S1 to be sold.

The main body 31 of the ejector constituted in this manner moves vertically with respect to the joint while being guided with both ejector guide grooves 36 and 36. Specifically, the main body 31 of the ejector slides between the allowing position (see FIG. 15) for allowing the product S1 to be sold next to move in a downward direction and the inhibiting position for inhibiting the downward movement of the product S2 to be sold next by supporting the product S2 to be sold next in collaboration with the passage wall 2*a*, the inhibiting position being defined with the contact of the main body 31 of thee ejector with the product S1 to be sold. Incidentally, the maximum slidable scope of the ejector 31 is set between the position at which the upper shaft 35*a* comes into contact with the upper end of the vertical guide groove 36*a* and the position at which the lower shaft 35*b* comes into contact with the end of the inclined guide groove 36*b*.

Furthermore, as shown in FIG. 5, the joint 32 has a main body 41 of the joint with a horizontally long square configuration, a pair of ejector connection portions 42 and 42 provided on a front surface of the main body 41 of the joint to sandwich the upper shaft 35*a* of the main body 31 of the ejector, a drive shaft connection portion 43 and a delivery shaft connection portion 44 provided on the rear surface of the main body 41 of the joint and having the drive shaft 52 and the delivery shaft 53 of the drive mechanism 6 described later inserted thereinto. Both side portions of the main body 41 of the joint are supported respectively with the rails 45 and 45 provided respectively on the above side plates 7 and 7 with the result that the main body 41 of the joint can be slided in a vertical direction along the rails 45 and 45 respectively. Both the drive shaft connection portion 43 and the delivery shaft connection portion 44 are both formed in such a manner that the cross sections thereof have a semi-circular configuration. At the same time, the through holes 43*a* and 44*a* are formed which extends in a vertical direction. In the through holes 43*a* of the drive shaft connection portion 43, a female screw which engages the male screw formed on the surface of the drive shaft 52 is formed while the through hole 44*a* of the delivery shaft connection portion 44 is formed in a size such that the delivery shaft 53 can be inserted loosely thereinto.

Furthermore, on the passage wall 2*a*, as shown in FIG. 1, the main body 31 of the ejector project to the product passage 2 to a predetermined length (in actuality, on the order of 3 to 5 mm) which is approximately the same as the height at which the main body 31 of the ejector supports the product to be sold next, and, at the same time, a support projection portion 2*b* is formed which extends to the same length as the horizontal width of the passage wall 2*a*. When the main body 31 of the ejector supports the product to be sold next in collaboration with the passage wall 2*a* by providing this support projection portion 2*b* on the passage wall 2*a*, the product S2 to be sold is easily stuck on the passage wall 2*a*.

Next, a drive mechanism 6 will be explained for unlocking the main body 11 of the stopper with the lock means 12 while driving the ejector 5 at the same time. As shown in FIG. 5, the drive mechanism 6 has a drive motor S1 (a drive source), a drive shaft 52 which is rotated and driven around an axial line with the drive motor (the drive source), a delivery shaft 53 arranged in parallel with the drive shaft 52 for delivering all the products S at one time at the time of exchanging all the products accommodated in the product passage 2, and a gear box 54 having a speed reducing gear row (not shown) for transmitting the drive force of the drive motor 51 to the drive shaft 52.

On the drive shaft 52, as shown in FIG. 5, on a portion upper than the gear box 54, a male screw is formed which engages the female screw of the drive shaft connection portion 43 of the joint 32 with the result that the drive shaft 52 is inserted into the through hole 43*a* of the drive shaft connection portion 43 in the state in which the male and the female screws are engaged with each other. As a consequence, when the drive shaft 52 is rotated around the axial line, the joint 32 moves in a vertical direction with the result that the main body 31 of the ejector slides between the allowing position and the inhibiting position. Furthermore, on the lower end portion projecting downward from the gear box 54, a small diameter portion 52*a* of the drive shaft extending in an axial direction and having a diameter smaller than the upper shaft diameter of the of the gear box of the drive shaft 52, and a large diameter portion 52*b* of the drive shaft (a first unlocking means and unlocking member) connecting the lower end of the small diameter portion 52*a* of the drive shaft, extending in an axial direction and having the same diameter as the shaft diameter. This small diameter portion 52*a* of the drive shaft is loosely inserted into one of the notches 28*a* of the locking member 22 while the large diameter portion 52*b* of the drive shaft becomes larger than the horizontal width of the notch 28*a* of the locking member. Consequently, as described later, the drive shaft 52 is driven in an upward direction so that the large diameter portion 52*b* of the drive shaft presses the vicinity of the notches 28*a* of the locking member from the lower side with the result that the locking member 22 is rotated by pulling up the connection portion 28 of the locking member 22.

Furthermore, as shown in FIG. 3, a compression spring 56 (a second energizing means) for energizing the drive shaft 52 in a downward direction is inserted into the bearing 55 of the upper end portion of the drive shaft 52. Consequently, as described later, when the drive shaft 52 is driven in an upward direction, the compression spring 56 is compressed. When the driving of the drive shaft 52 in an upward direction is released, the drive shaft 52 is driven in a downward direction with the return force of the compression spring 56. Incidentally, in the place of such compression spring 56. a pull spring may be provided for energizing the drive shaft 52 in a downward direction on the lower end portion of the drive shaft 52. Furthermore, the drive shaft 52 in the gear box 54 is loosely inserted into the gear (not shown) which engages the speed reducing gear (not shown), and the cross section of the drive shaft 52 at the portion which is loosely inserted into the gear is formed in a regular hexagonal configuration or a D-like configuration. As a consequence, the drive force of the driving motor S1 can be transmitted to the drive shaft with certitude via the gear (not shown). At the same time, the drive shaft 52 can be moved in a vertical direction without moving the gear up and down.

On the other hand, the delivery shaft 53 is constituted approximately in the same manner as the drive shaft 52 except for the fact that a male screw is formed on the surface with respect to the drive shaft 52. However, on an upper portion of the delivery shaft 53, a pressed portion 57 which is pressed to the upper end portion of the main body 41 of the joint when the main body 31 of the joint moves further upward exceeding the allowing position of the main body 31 of the ejector.

Here, unlocking of the main body 11 of the stopper and driving of the main body 31 of the ejector by the drive mechanism will be explained in order with respect to the time of selling the product and the time of exchanging the product. In the beginning, at the time of selling the product, the drive motor 51 of the drive mechanism is operated and rotated in a normal direction. When the drive shaft is rotated and driven in a predetermined direction, the joint engaging the drive shaft moves in a downward direction. Along with this, the main body 31 of the ejector slides toward the inhibiting position. Then, the lower end of the main body 31 of the ejector comes into contact with the upper portion of the product S1 to be sold, and the main body 31 of the ejector reaches the inhibiting position (see FIG. 10), the joint 32 which has moved in a downward direction is suspended. When the drive shaft continues to rotate after the main body 31 of the ejector reaches the inhibiting position, the drive shaft 52 moves in an upward direction with respect to the joint 32 which is suspended while compressing the compression spring 56. As a consequence, when the lock member 22 at the engaging position which member is connected to the lower end portion of the drive shaft 52 is rotated and driven toward the detachment position, the lock of the main body 11 of the stopper at the closed position is unlocked. As a consequence, the main body 11 of the stopper is rotated and driven toward the open position with the weight of the product S1 to be sold with the result that the product S1 to be sold is delivered from the product passage 2. When the contact of the main body 11 of the ejector to the product S1 to be sold is released by the delivery of the product to be sold, the drive shaft 52 is driven in a downward direction with the return force of the compression spring 56 to return to the original position.

On the other hand, at the time of exchanging the products, when a predetermined button (instruction means) not shown is operated which is operated for supporting the delivery of all the products at one time which are accommodated in the product passage 2, the drive motor 51 is operated in a reverse direction unlike the time of selling the products with the result that the drive shaft is also rotated in a reverse direction. Consequently, the joint 32 moves in an upward direction, and along with this, the main body 31 of the ejector moves further in an upward direction over the allowing position. Then, the upper end portion of the main body 41 of the joint presses the pressed portion 57 from the lower side with the result that the delivery shaft 53 is raised in an upward direction. As a consequence, the lock member at the engaging position which member is connected to the lower end portion of the delivery shaft 53 is rotated and driven toward the detachment position so that the main body 11 of the stopper at the closed position is unlocked.

In this manner, the main body 31 of the ejector moves in an upward direction at least above the allowed position, and the main body 11 of the stopper at the closed position is unlocked so that all the products S in the product passage are delivered at one time. Consequently. in the case where a plurality of products are already accommodated in the product passage 2, and these products S are exchanged with other products, all the products S accommodated in the product passage 2 can be delivered at one time and in a package by the operation of the predetermined button by the operator with the result that exchange work of the product S can be conducted in a short time. In this manner, the second unlocking means of the present invention for delivering all the products S accommodated in the product passage 2 at one time comprises a delivery shaft 53, a drive mechanism 6, and an ejector 5.

Next, referring to FIGS. 9 through 30, the delivery of the product S having each kind of size and configuration by the product delivering device which is constituted as described above will be explained in this manner.

Specifically, there will be explained a case in which the product S accommodated in the product passage 2 is accommodated, a case in which the product S is a thin canned product (FIGS. 9 through 15), a case in which the product S is a thick canned product (FIG. 16). a case in which the product S is a square PET bottle (FIGS. 17 through 23), and a case in which the thin canned products and thick canned products are mixed and. accommodated in the product passage (FIGS. 24 through 30). Incidentally, in the forgoing explanation, there will be explained the delivery of products in the case where the thin canned products are accommodated in the product passage. With respect to the delivery of products in other cases, different points will be explained.

Figure 9:
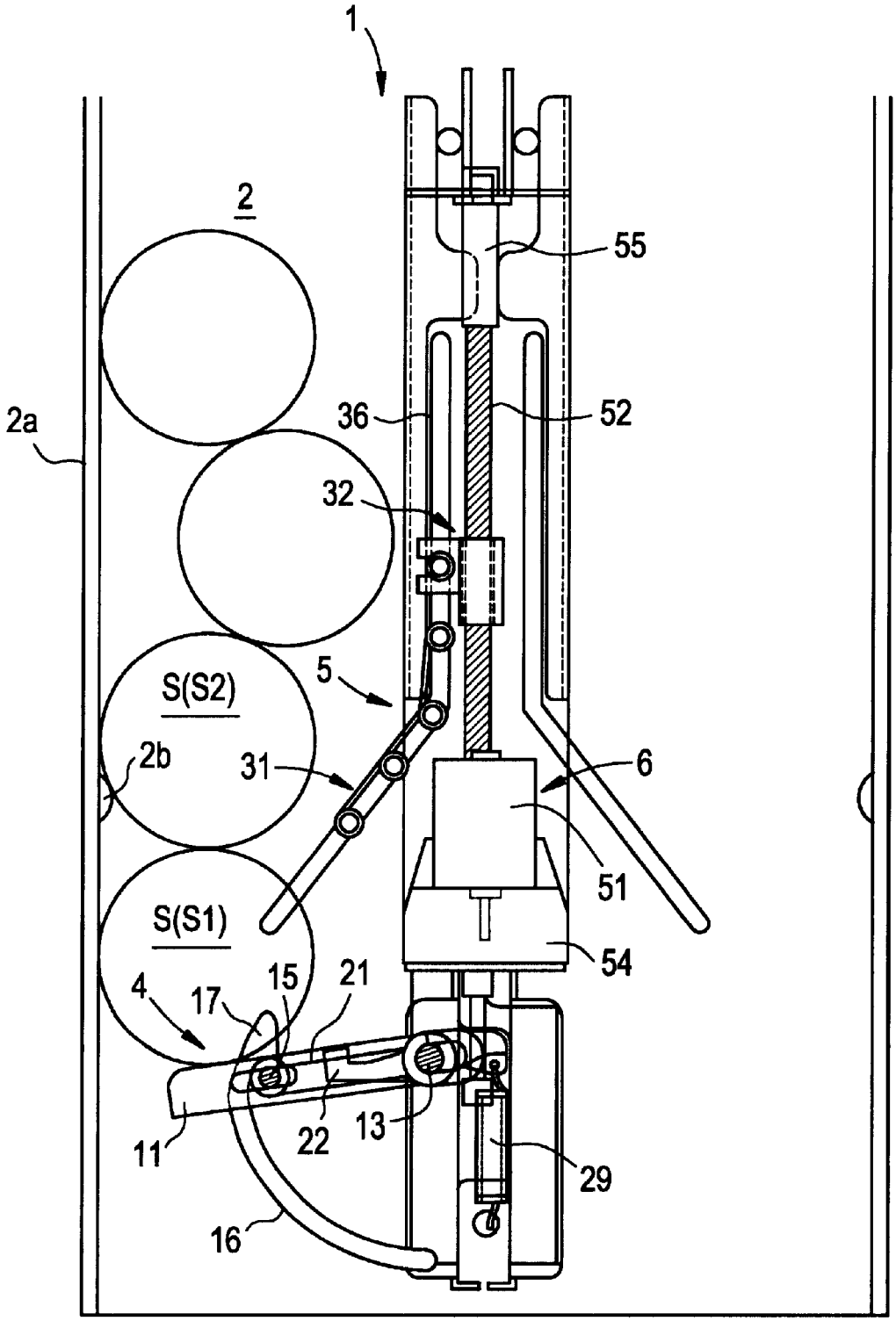
FIG. 9 is a side sectional view showing a product delivering device for explaining the delivering of a thin canned product, the view showing the state before the main body of the ejector begins to move.

FIG. 9 is a view showing a product delivering device 1 which accommodates thin canned products in the product path 2 and which is set in the sales waiting state. The main body 11 of the stopper is located in the closed state, and the main body 31 of the stopper supports the product S1 to be sold from the lower side and the product to be sold S1 supports the lower side of the product to be sold next S2.

Figure 10:
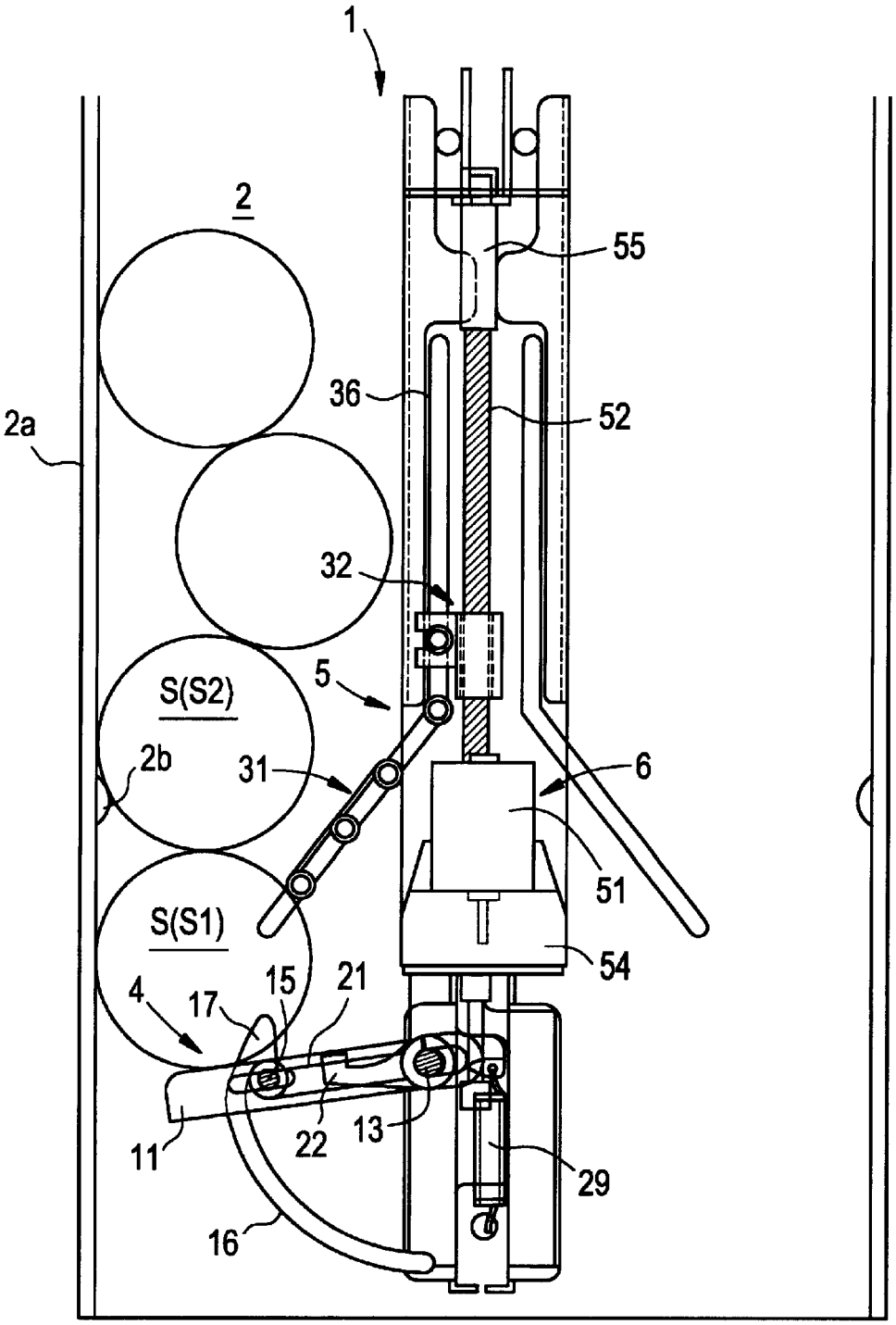
FIG. 10 is a side sectional view following FIG. 9 and showing the product delivering device, the view showing the state immediately after the main body of the ejector comes into contact with the product to be sold.
Figure 11:
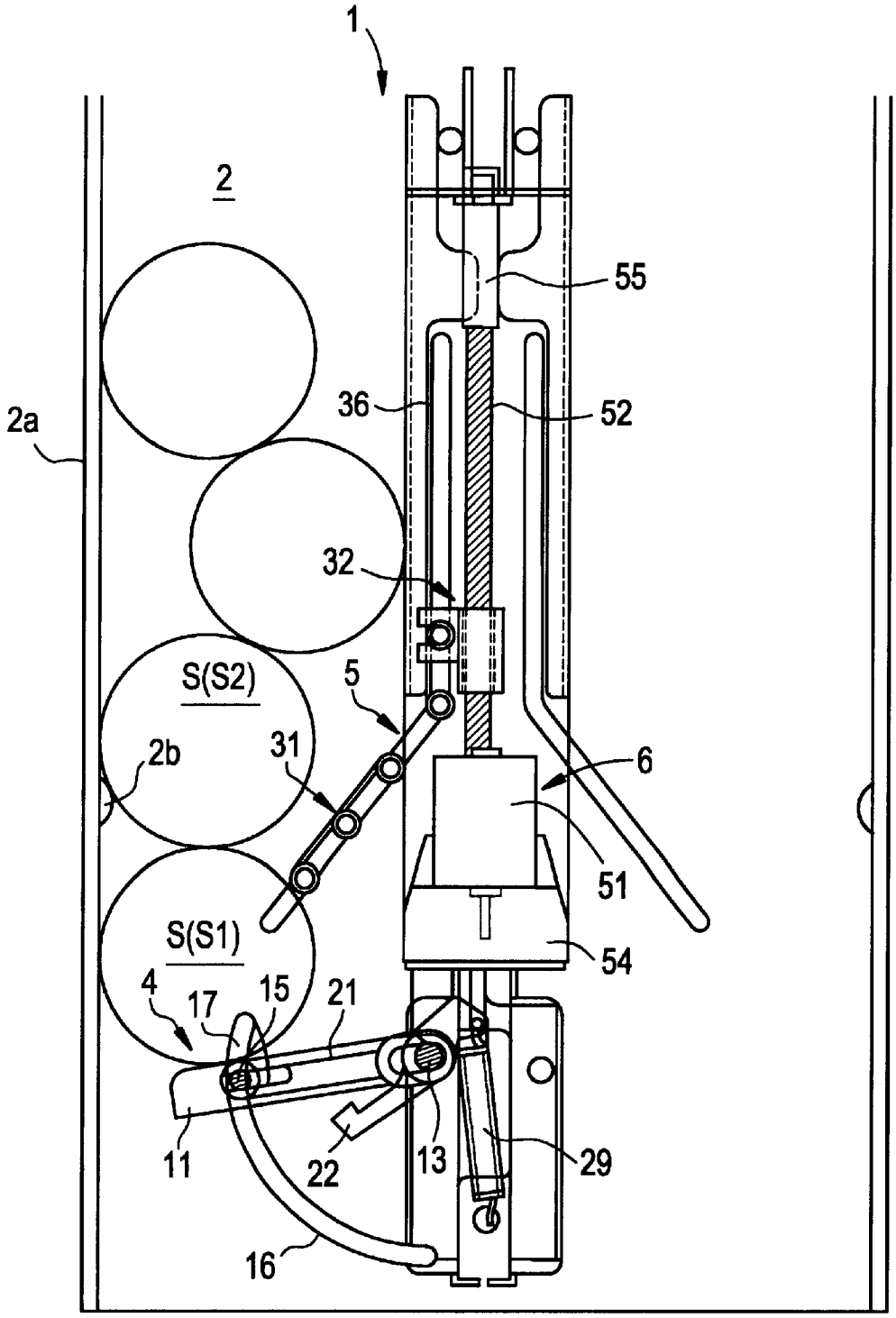
FIG. 11 is a side sectional view following FIG. 10 and showing the product delivering device, the view showing the state in which the lock member is detached from the slide member.
Figure 12:
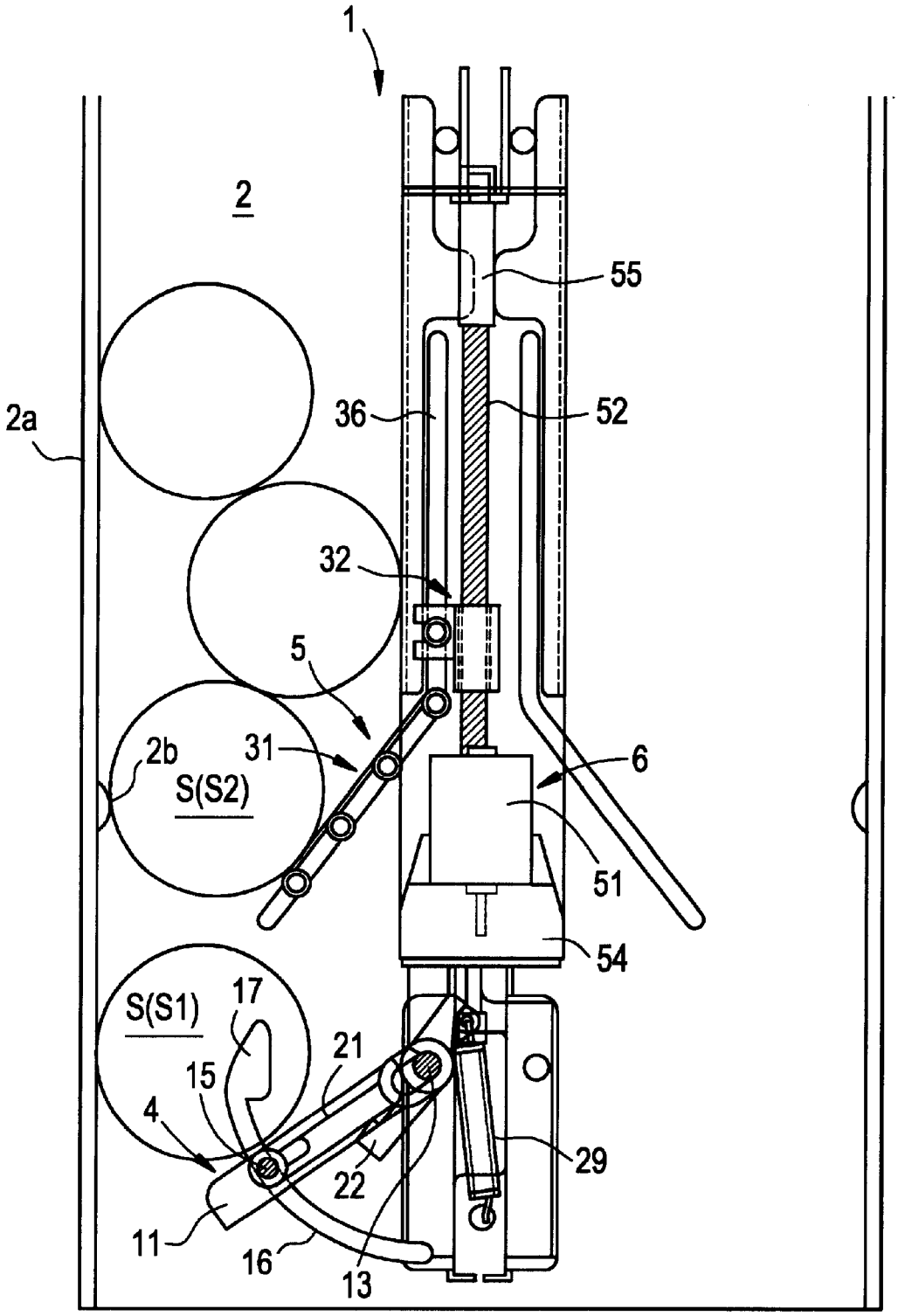
FIG. 12 is a side sectional view following FIG. 11 and showing the product delivering device, the view showing the state in which the main body of the stopper is rotated toward the open position.

When the state moves from the sales waiting state to the sales state, the drive motor 51 rotates in the normal direction. The drive shaft 52 is rotated in a downward direction on the basis of the rotation in a predetermined direction of the drive shaft 52 to allow the main body 31 of the ejector to slide toward the inhibiting position. Next, as shown in FIG. 10, the main body 31 of the ejector comes into contact with the upper portion of the sales product S1 by the sliding along the ejector guide groove 36 to come into contact with the upper portion (the inhibiting position) of the product S to be sold thereby suspending the operation. The joint 32 suspends the movement in a downward direction on the basis of the suspension of the main body 31 of the ejector. The drive motor 52 relatively moves the drive shaft 52 in an upward direction with respect to he joint 32 by a continuous rotation even after the main body of the ejector reaches the inhibiting position. Next, as shown in FIG. 11, the lock member 22 is rotated in a counterclockwise direction on the basis of an upward movement of the drive shaft 52 to unlock the main body 11 of the stopper. The slide member 21 slides on the basis of the unlocking of the main body 11 of the stopper. Next, as shown in FIG. 12, the main body 11 of the stopper is rotated in a counterclockwise direction toward the open position centering on the rotation shaft 13 with the weight of the product S1 to be sold. The main body 11 of the stopper opens the product passage 2 on the basis of the fact that the main body 11 of the stopper is rotated toward the open position with the result that the product S1 to be sold is allowed to come down in a downward direction to be delivered to the sales port (not shown).

At this time, the main body 31 of the ejector supports the product S2 to be sold next in collaboration with the passage wall 2*a*. When the product S2 to be sold next is detached from the main body 31 of the ejector with the delivery from the vending machine, the drive shaft 52 which has moved upward is energized in a downward direction with the return force of the compression spring 56 to return to the original position. The drive motor 51 suspends the operation when the return of the drive shaft 52 to the original position is detected.

Figure 14:
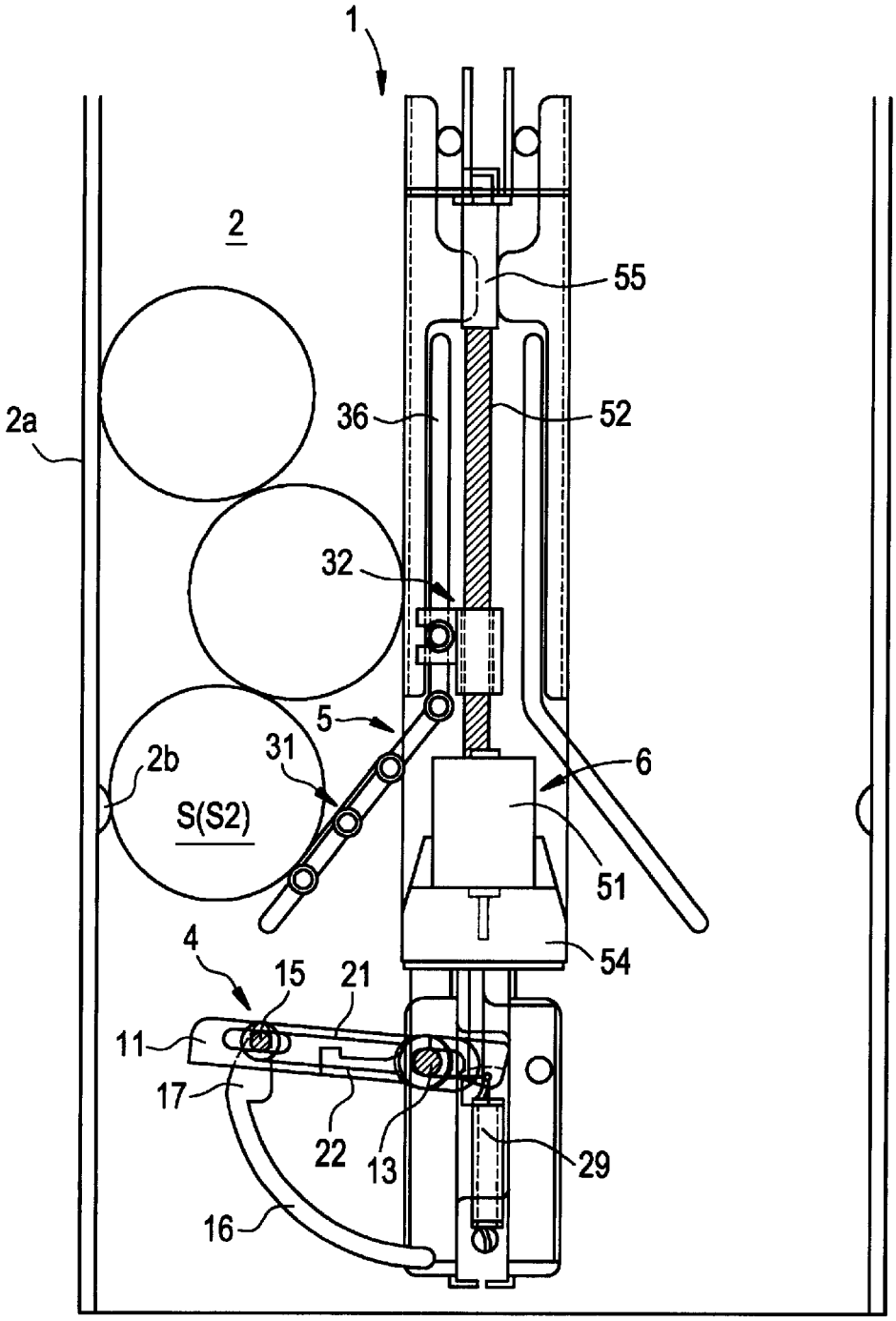
FIG. 14 is a side sectional view following FIG. 13 and showing the product deliver device, the view showing a state in which the main body of the stopper is rotated to the closed position of the main body of the stopper
Figure 15:
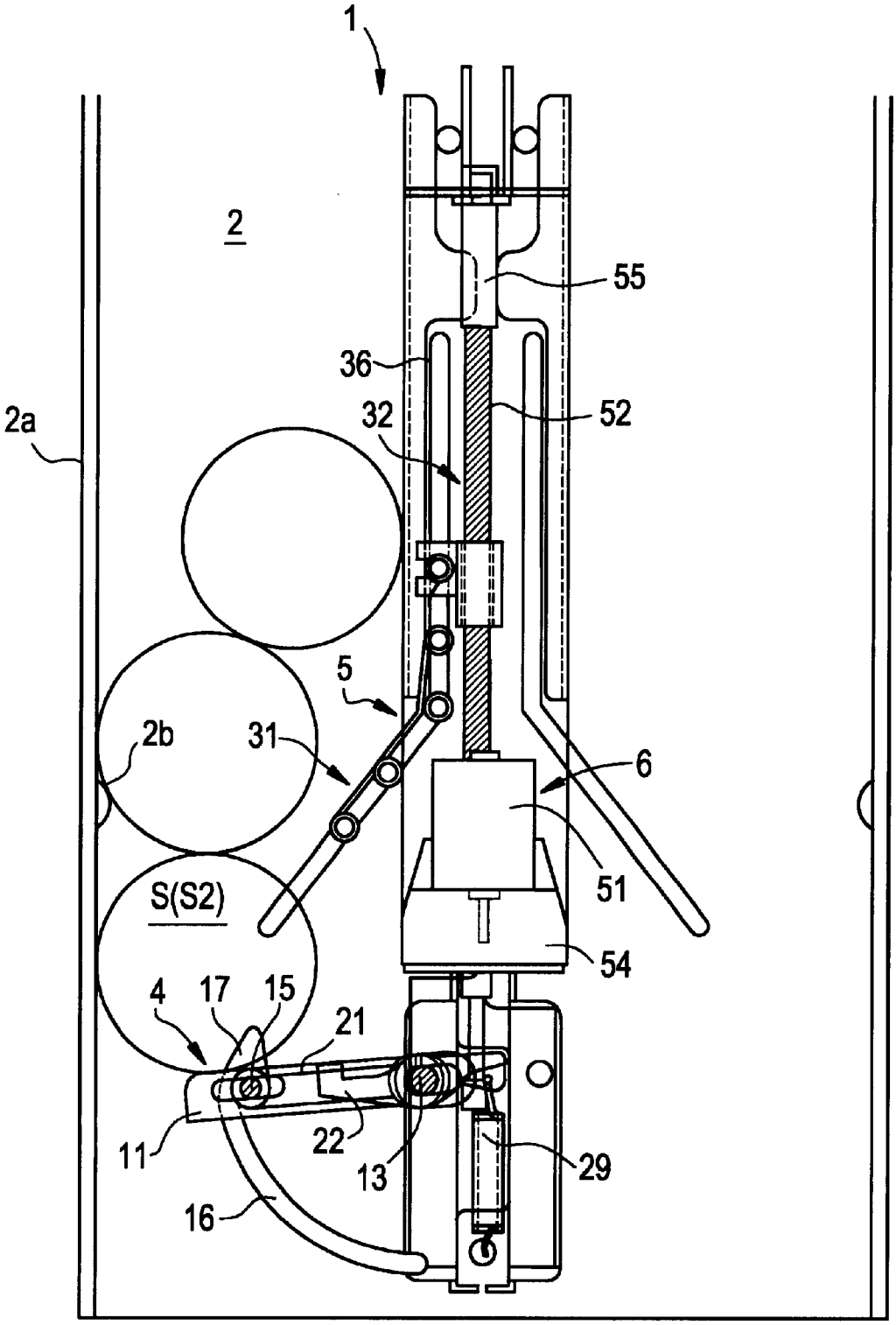
FIG. 15 is a side sectional view following FIG. 14 and showing the product delivering device, the view showing the state in which the main body of the stopper is rotated to the closed position and the stopper is locked with the coming down of the product to be sold next which has been supported with the main body of the ejector.

When the product S1 to be sold is delivered, the lock member 22 is rotated in the clockwise direction centering on the rotation shaft 13 with the return force of the pull spring 29. The lock member 22 presses the main body 11 of the stopper 11 from the lower side with the engaging projection portion 27*a* on the basis of the rotation. Next, as shown in FIG. 14. the main body 11 of the stopper is rotated in the clockwise direction to a position at which the lock shaft 15 together with the lock member 22 comes into contact with the upper end portion of the shaft anchor groove 17. Next, when the drive motor 51 is rotated in a reverse direction, the drive shaft 52 is rotated is a direction opposite to the rotation direction. The joint 32 moves in an upward direction on the basis of the rotation of the drive shaft 52. The main body 31 of the ejector slides to the allowing position on the basis of the rise of the joint 32. When the main body 11 of the ejector reaches the allowing position, the product S2 to be sold next moves in a downward direction and comes down onto the main body 11 of the stopper. The main body 11 of the stopper is rotated to some extent with the weight of the product S2 to be sold next. As shown in FIG. 15, the main body 11 of the stopper suspends at the closed position. The drive motor 51 is suspended when the fact that the product S2 to be sold next comes down on the main body 11 of the stopper is detected with the means for detecting the product to be sold comprising a senor or the like (not shown). The product S2 to be sold next which comes down on the main body 11 of the stopper is the product to be sold at the time of the next sales.

Figure 16:
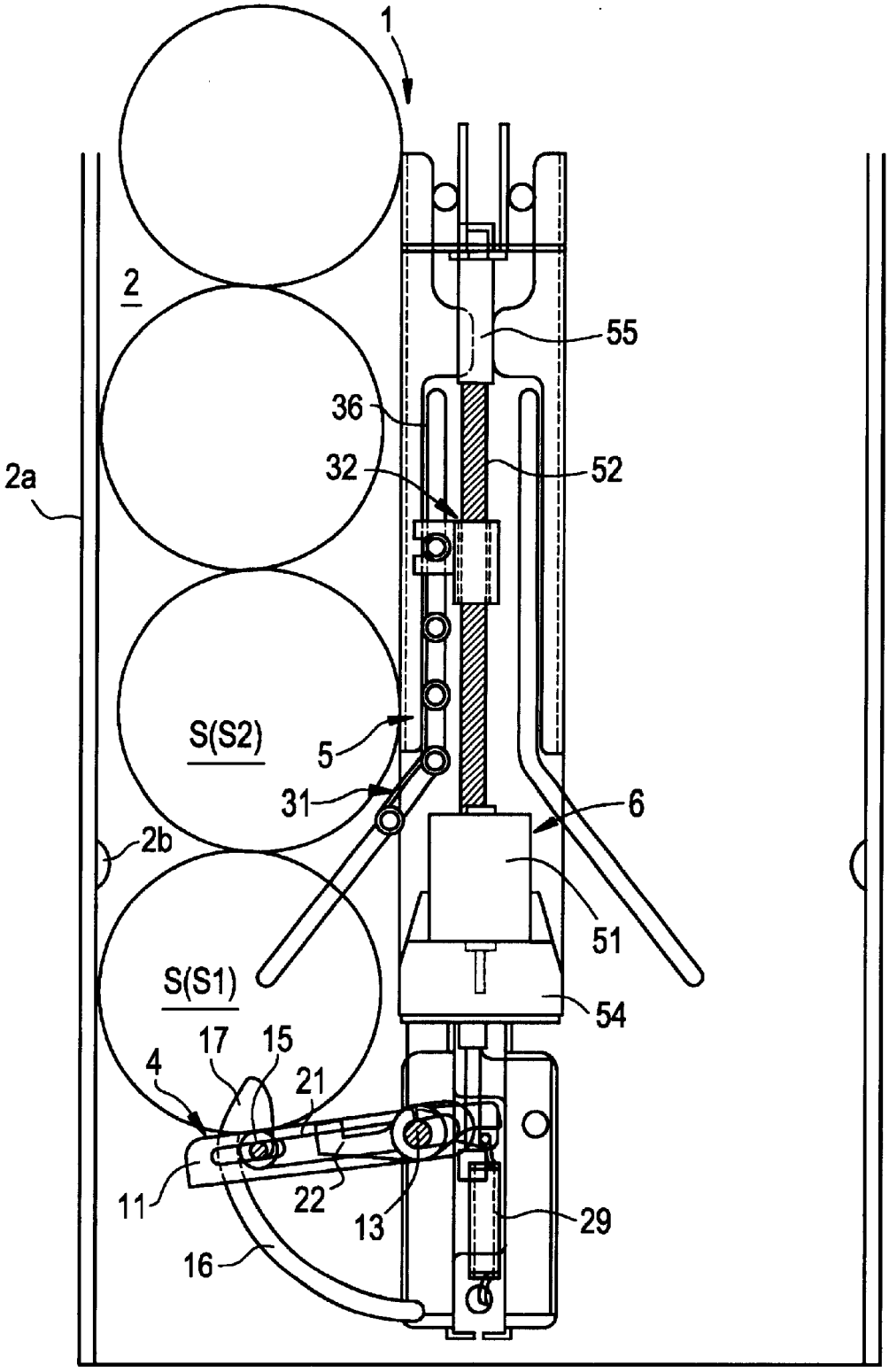
FIG. 16 is a side sectional view showing the product delivering device, the view showing the state before the main body of the ejector begins to move.
Figure 17:
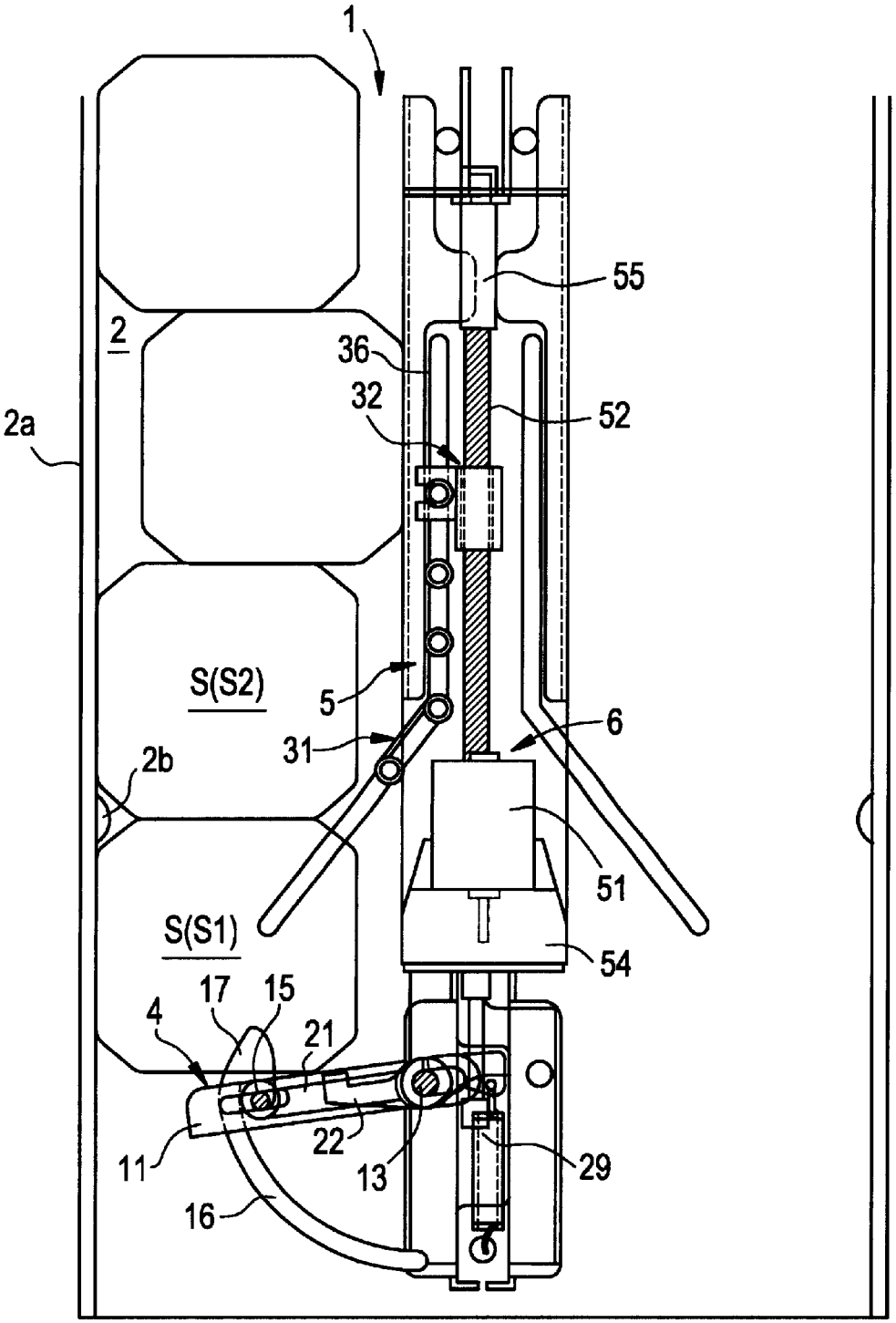
FIG. 17 is a side sectional view showing the product delivering device for explaining the delivering of a square shaped PET bottle, the view showing the state before the main body of the ejector begins to move.

FIG. 16 is a view showing the product to be sold next which accommodates the thick canned product in the product passage 2 and which is set to the sales waiting state. In this case, the product delivering device 1 is operated in the same manner as the above product delivering device 1 for delivering the thin canned products except for the fact that the allowing position and the inhibiting position are recessed than the case in which the thin canned products are delivered.

Figure 18:
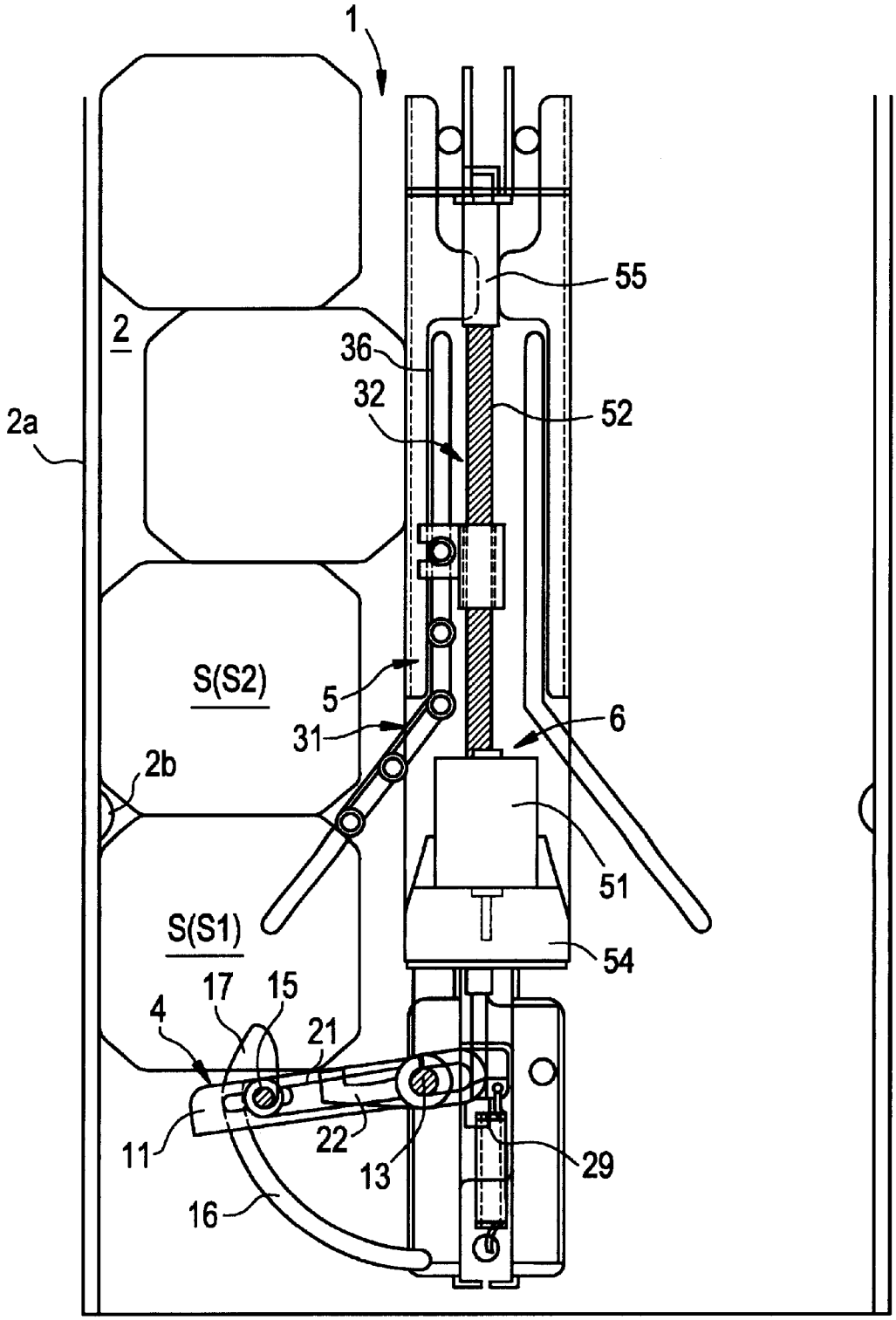
FIG. 18 is a side sectional view following FIG. 17 and showing the product delivering device, the view showing the state in which the main body of the ejector, the view showing the state immediately after the main body of the ejector comes into contact with the product to be sold.
Figure 19:
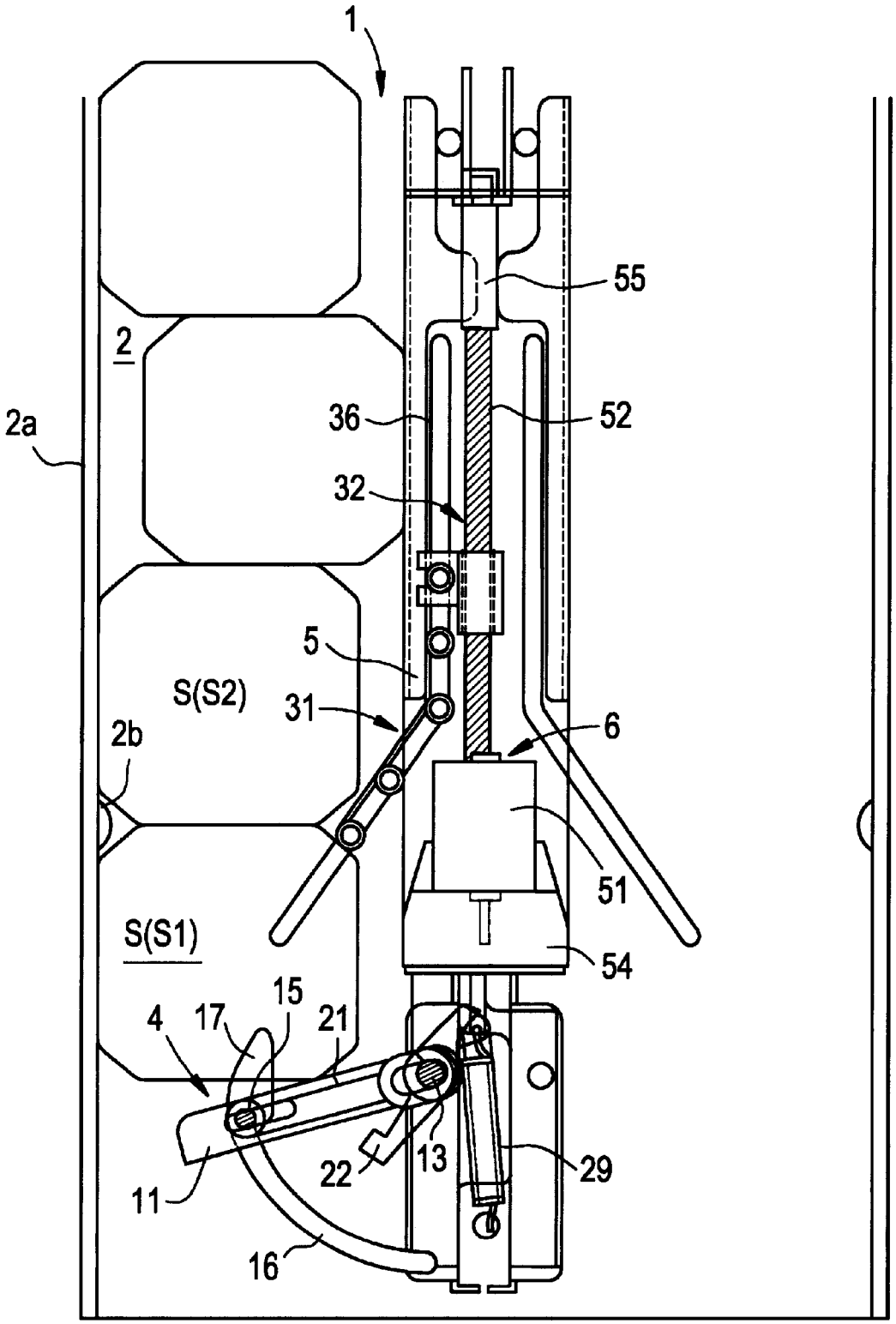
FIG. 19 is a side sectional view following FIG. 18 and showing the product delivering device, the view showing the state in which the lock member is detached from the slide member.
Figure 20:
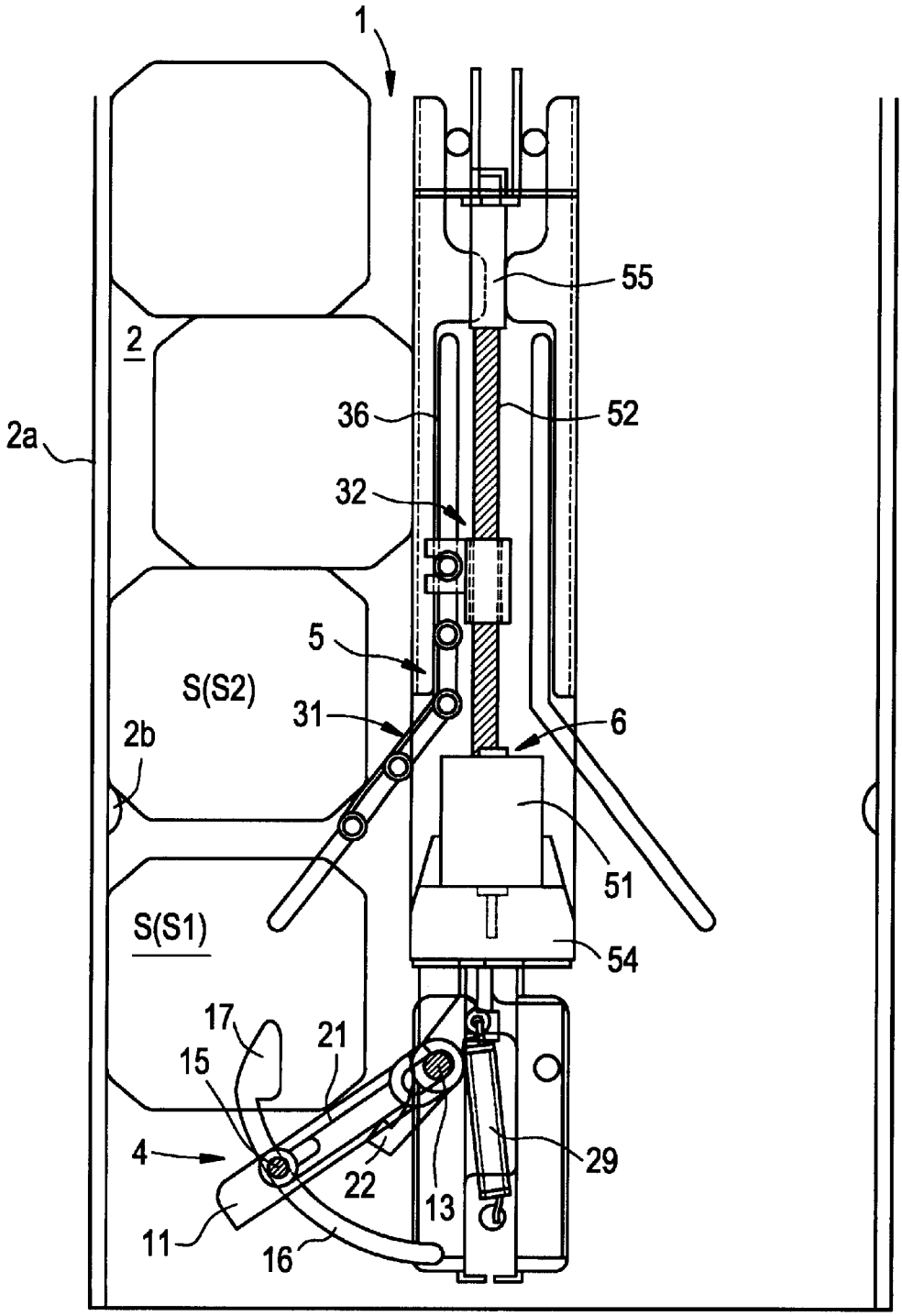
FIG. 20 is a side sectional view following FIG. 19 and showing the product delivering device, the view showing the state in which the main body of the stopper is rotated to the open position of the main body of the stopper.

FIGS. 17 through 23 are views showing the product delivering device 1 in the case where square PET bottle products are accommodated in the product passage 2, FIGS. 17 through 23 corresponds to FIGS. 9 through 15 showing the delivery of the thin canned products which has been explained above. FIG. 18 is a view showing the state in which the main body 31 of the product comes into contact with the product S1 to be sold next. The main body 31 of the ejector supports the chamfered portion at two locations of the lower portion of the product to be sold next in collaboration with the main body 31 of the ejector and the support projection portion 2*b* of the passage wall 2*a*. As a consequence, square PET bottles to be sold next can be appropriately supported as compared with the case in which the product S2 to be sold next is supported in collaboration with the main body 31 of the ejector, and the passage wall 2*a* without the support projection portion 2*b*.

Figure 24:
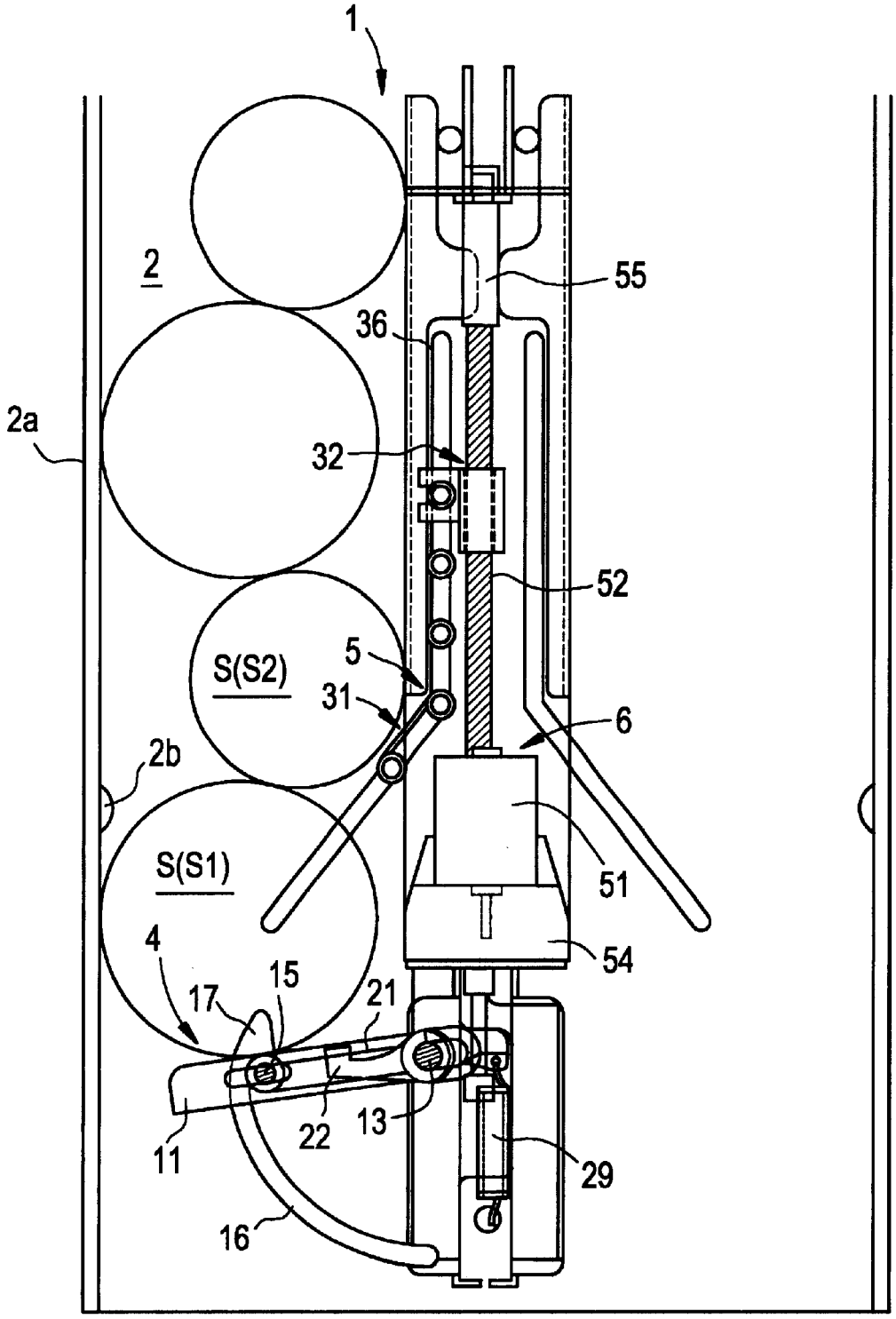
FIG. 24 is a side sectional view showing the product delivering device for explaining the delivery of the product from the product passage in which large canned products and thin canned products are accommodated in a mixed manner, the view showing the state before the main body of the ejector begins to move.
Figure 25:
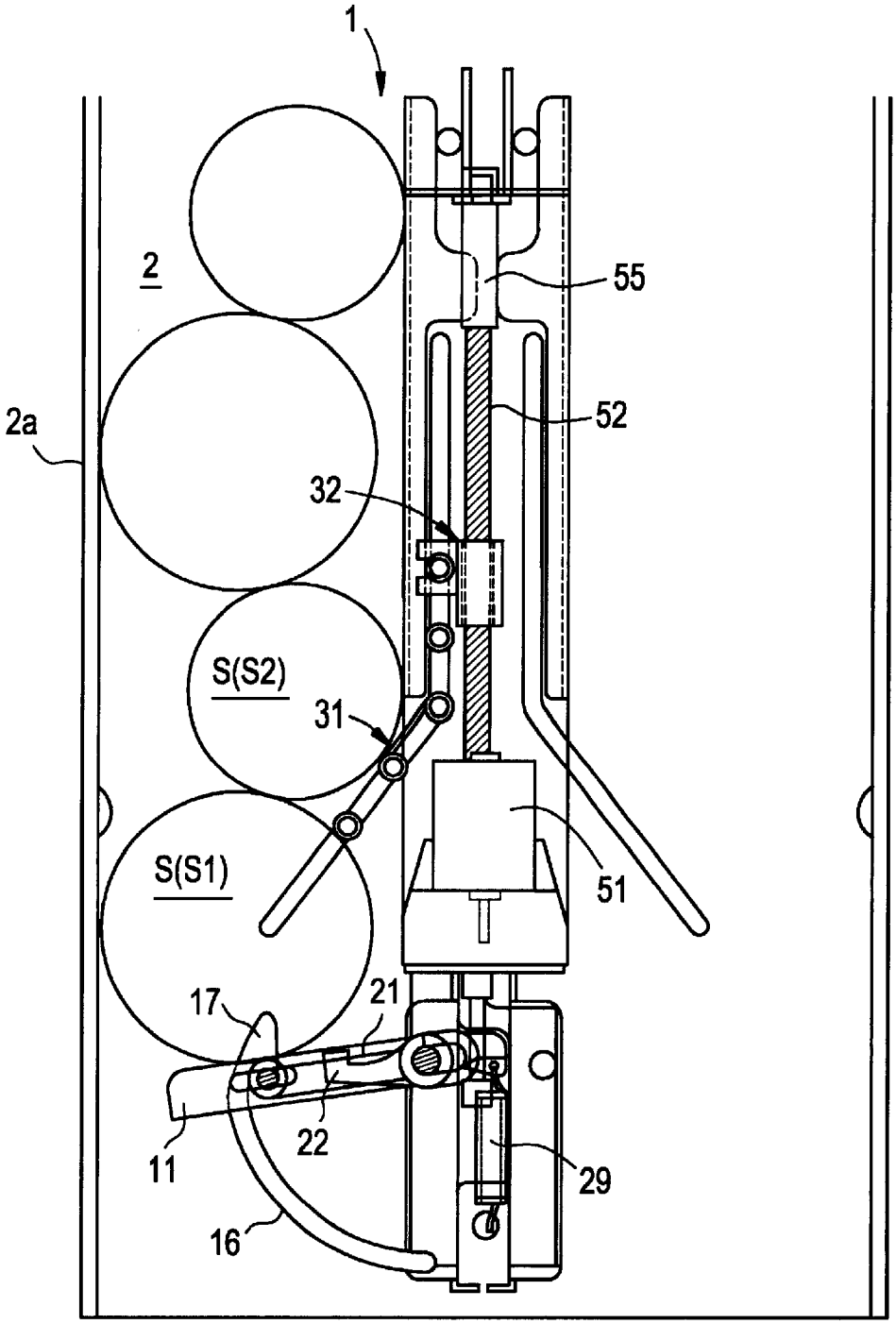
FIG. 25 is a side sectional view following FIG. 24 and showing the product delivering device, the view showing the state immediately after the main body of the ejector comes into contact with the thick canned product to be sold.
Figure 26:
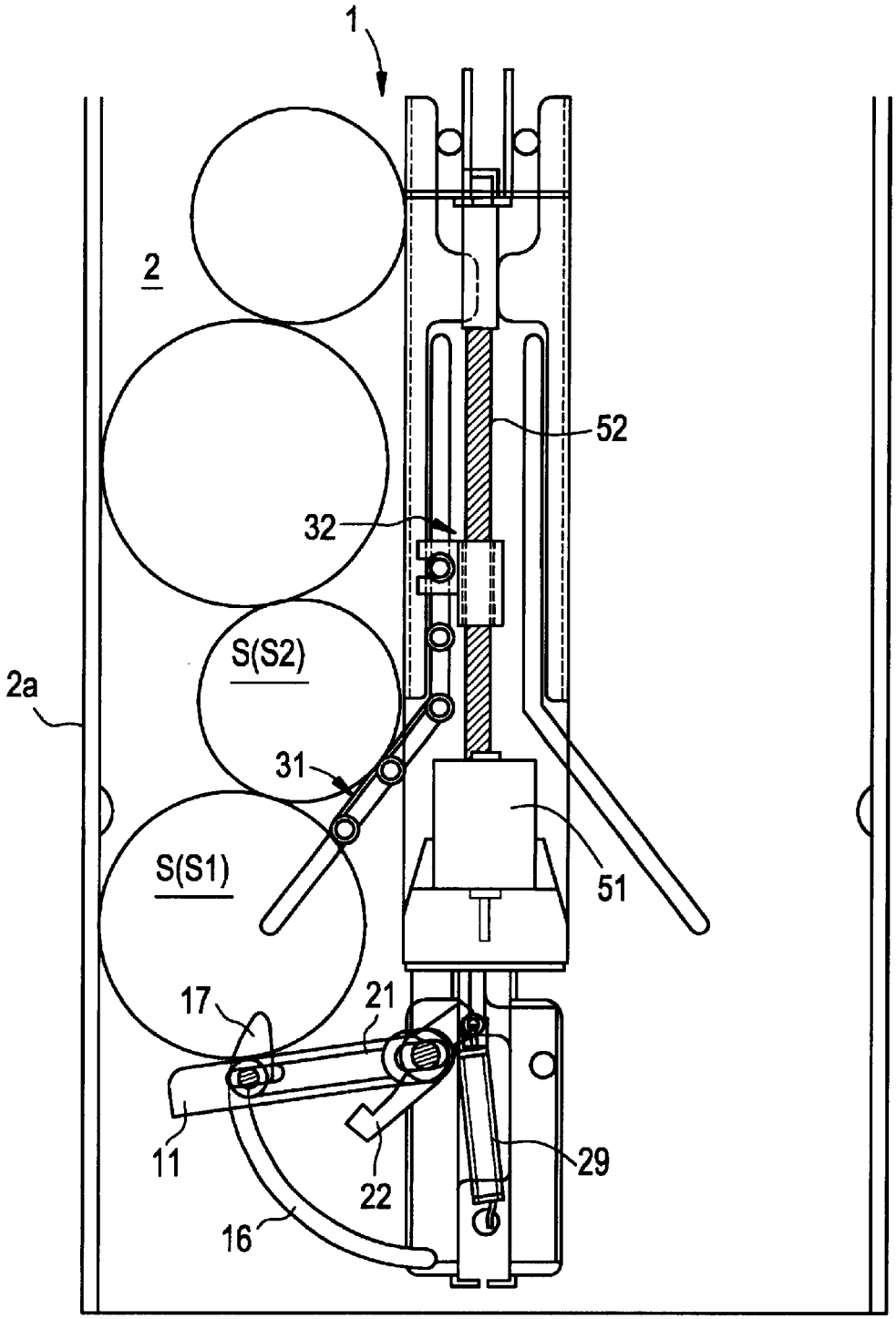
FIG. 26 is a side sectional view following FIG. 25 and showing the state in which the lock member is detached from the slide member.
Figure 27:
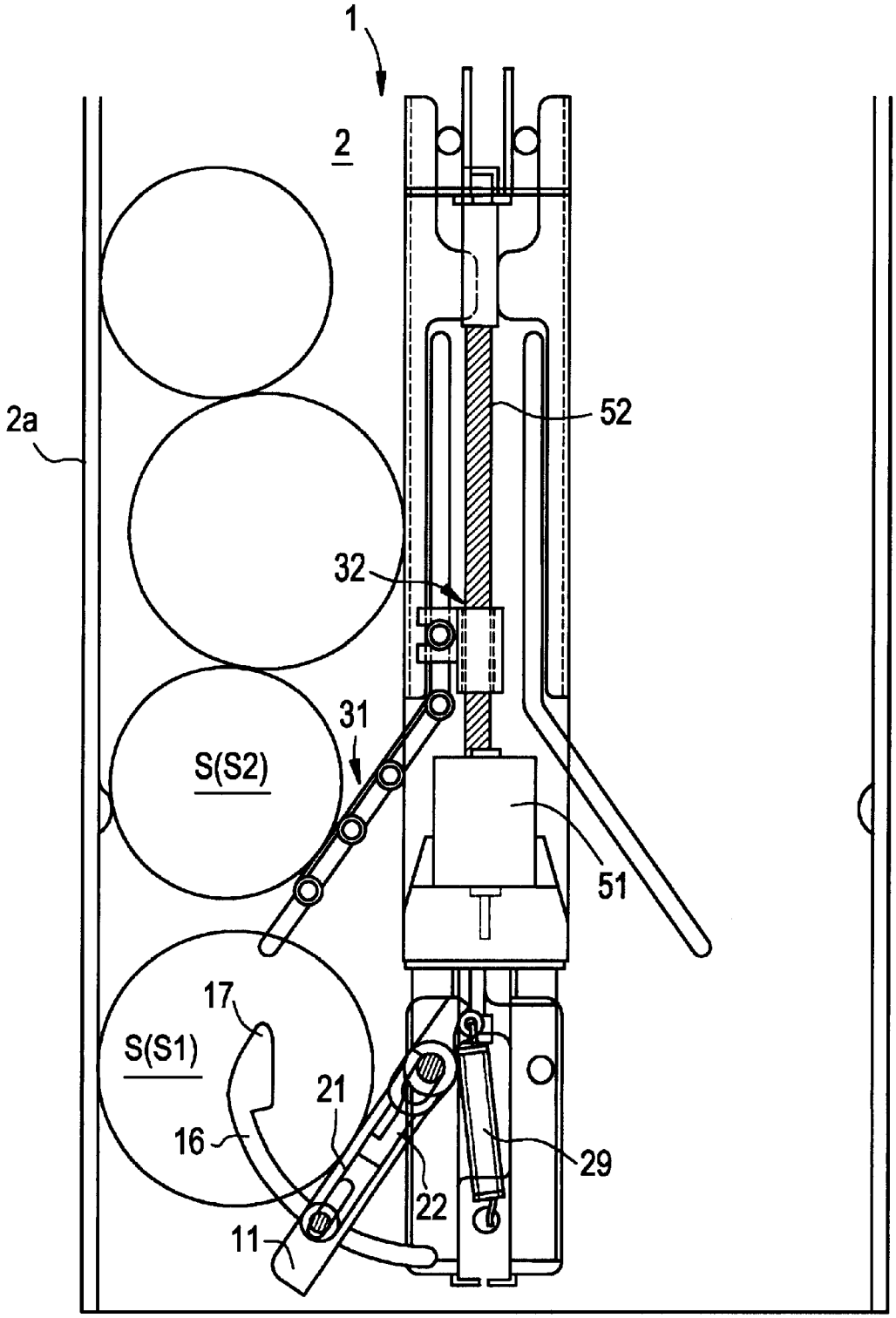
FIG. 27 is a side sectional view following FIG. 26 and showing the product, the view showing the state in which the main body of the stopper is rotated to the open position.

FIGS. 24 through 30 are views showing an operation of the product delivering device 1 in the case in which thick canned products and thin canned products are mixed and accommodated in the product passage 2. FIGS. 24 through 30 corresponds to FIGS. 9 through 15 showing the delivery of thin canned product as has been explained above. As shown in FIG. 24, when the product S1 to be sold is thick canned product and the product S2 to be sold next is a thin canned product, the inhibiting position of the main body 31 of the ejector is set to a position corresponding to the thick canned product. When the product to be sold is a thin canned product (see FIG. 10), the position is set to a position recessed more. At this inhibiting position, there is a fear that the main body 31 of the ejector cannot support the product to be sold next, which is the thin canned product in collaboration with the passage wall 2*a*. However, the main body 31 of the ejector slides further to the side of the passage wall 2*a* over the initial inhibiting position, as shown in FIG. 27 because the drive shaft 52 moves in a downward direction with the return force of the compression spring at the same time when the contact of the main body 31 of the ejector with the product S1 to be sold is released with the delivery of the product S1. Consequently, even in the case where thick canned products and thin canned products are mixed and accommodated in the product passage 2 on purpose, and even in the case where products having different sizes are accommodated in the product passage 2 by mistake, the main body 31 of the ejector can support the product S2 to be sold next in collaboration with the passage wall 2*a* thereby preventing selling large number of products.

As has been explained above, according to the product delivering device of the present invention, since the inhibiting position at which the main body 31 of the ejector supports the product S2 to be sold next can be appropriately set automatically and steplessly in accordance with the size and the configuration of the product, only the product to be sold S1 can be delivered with certitude at the time of selling the product irrespective of the size and the configuration of the product S to be sold with the result that the flexibility of the product delivering device 1 with respect to the product S to be sold.

Furthermore, since the lock mechanism 18 for locking the main body 11 of the product to be sold to the closed position is arranged between the side plates 7 and 7, the width of the product delivering device 1, namely, generally, the width of the product delivering device in the right and the left direction of the automatic. vending machine can be made small. As a consequence, the product delivering device can be constituted in a compact size, and can be installed in a limited space with the result that the width in the right and the left direction can be made small.

Furthermore, when the lock member 22 located at the engaging position is rotated and driven to the detachment position against the pull spring 29 with the drive mechanism, the engaging projection portion 27 of the lock member 22 is detached from the slide member 21 and is set to the state in which the, lock member is not in contact with the main body 11 of the stopper with the result that the energizing force of the pull spring 29 ceases to be transmitted to the main body of the stopper. Consequently, when the main body 11 of the stopper at the closed position is unlocked, the main body 11 of the stopper can be easily rotated to the open position with the weight of the product S1 to be sold can be delivered with certitude, Incidentally, the present invention can be practiced in various forms without being restricted to the embodiments which have been explained. Furthermore, detailed structure of the product delivering device shown in the embodiments are shown only as an illustration, and can be appropriately modified within the scope of the gist of the present invention.

As has been described in detail, the product delivering device of the automatic vending machine of the present invention has an advantage of delivering only products to be sold with certitude at the time of selling the products irrespective of the size and the configuration of the product to be sold.

What is claimed is:

1. A product delivering device of an automatic vending machine comprising:

a stopper which projects into a product passage to support a product to be sold;

an ejector which projects into the product passage to support a product to be sold next after the product to be sold; and control means for controlling a projection quantity to the product passage of the ejector;

wherein the control means allows the ejector to project into the product passage to support product to be sold next upon receipt of a sales instruction, and at the same time, opens the stopper to deliver the product to be sold from the product passage to the sales port thereby closing the product passage with the stopper after the delivery of the product to be sold while supplying the product to be sold next on the stopper by allowing the ejector to be recessed.

2. The product delivering device of the automatic vending machine according to claim 1, wherein the ejector projects into the product passage in the projection quantity in accordance with the size of the product to be sold accommodated in the product passage.

3. A product delivering device of an automatic vending machine comprising:

a stopper which projects into a product passage to support a product to be sold;

an ejector which projects into the product passage to support a product to be sold next after the product to be sold; and drive means having a drive shaft for driving the stopper and the ejector with the movement into an axial direction on the basis of the rotation movement;

wherein the drive means drives the stopper and the ejector to deliver the product to be sold to a sales port by constraining the product to be sold next after the product to be sold by the rotation of the driving shaft in a first direction, moves the stopper to the sales waiting position by rotating the driving shaft in a second direction and, at the same time, driving the stopper and the ejector so as to supply the product to be sold next to the sales waiting position from the product passage.

4. The product delivering device of the automatic vending machine according to claim 3, wherein the stopper has drive portion rotatably supported on a fixed system via a rotation shaft to receive a drive force from the drive means, and a rotation member formed of an opening and closing portion for opening and closing a product passage on the basis of the drive force.

5. The product delivering device of the automatic vending machine according to claim 3, wherein the ejector has a plate-like member which projects in an inclined manner into a product passage on the basis of the driving of the drive means, and a guide groove for guiding both ends of the plate-like member.

6. The product delivering device of the vending machine according claim 3, wherein the drive means has a drive motor which generates a rotation force for rotating the drive shaft in a first or a second direction, a first screw portion provided on the drive shaft for converting the rotation force into a to and fro movement into an axial direction of the drive shaft, a second screw portion engaging with the first screw portion and a joint portion engaged with the ejector to be supported on the drive shaft in such a manner that the joint portion can be moved to and fro.

7. A product delivering device of an automatic vending machine for delivering a product located at the lowest position out of a plurality of products accommodated in a product passage in a downward direction at the time of selling the product in the state in which the plurality of products placed in a horizontal direction are stacked in a vertical direction, the device comprising:

opening and closing means of the product passage movable between a closed position for closing the product passage so as to inhibit the delivery of the product to be sold, and an open position for opening the product passage so as to allow the delivery of the product, the means being capable of being driven toward the open position from the closed position with the weight of the product to be sold;

allowing means for allowing the movement in a downward direction the product to be sold next located immediately on the product to be sold;

means for supporting the product to be sold next movable between the allowing position for allowing the downward movement of the product to be sold next located immediately on the product to be sold and an inhibiting position for inhibiting the downward movement of the product to be sold next by supporting the product to be sold next in collaboration with the passage wall located opposite to the product passage, the inhibiting position being defined in contact with the upper portion of the product to be sold;

driving means for driving the means for supporting the product to be sold next between the inhibiting position and the allowing position;

locking means for locking the product opening and closing means to the closed position; and a first unlocking means for unlocking the lock of the opening and closing means of the product passage by the locking means when the means for supporting the product to be sold next moves to the inhibiting position at the time of selling the product.

8. The product delivering device according to claim 7, wherein a projection portion having a height projecting to a predetermined length is provided on the passage wall, the height being approximately the same as the height at which the means for supporting the product to be sold next supports the product to be sold next.

9. The product delivering device according to claim 7 or 8, wherein the opening and closing means of the product passage has:

an opening and closing member which rotates on the base end portion between the closed position and the open position, the member having a long hole-like through hole extending in parallel with the rotation axial line and having a cross section extending in radial direction with respect to the center of the rotation; and a pair of guide portions provided opposite to each other with the opening and closing means located therebetween and extending in arc-like configuration centering on the rotation axis for guiding the opening and closing member between the closed position and the open position, and the locking means has a lock shaft being inserted loosely into the through hole of the opening and closing means, and, at the same time, having both end portions projecting to the outside engaging the pair of guide portions respectively, the lock shaft being slidable in a direction of the through hole when the opening and closing member is located at the closed position, an anchor portion provided respectively on the pair of guide portions so as to be projected in a radial direction with respect to the center of rotation to anchor the lock shaft, and a lock mechanism for locking the lock shaft into the anchor portion.

10. The product delivering device of the automatic vending machine according to claim 9, wherein the through hole of the opening and closing member is provided on the end portion of the opening and closing member.

11. The product delivering device of the automatic vending machine according to claim 9 or 10 wherein the lock mechanism is arranged between a pair of guide portions.

12. The product delivering device of the automatic vending machine according to claim 9 or 11, wherein the lock member has a slide member attached with the lock shaft and constituted slidably between the lock position at which the lock shaft anchors the anchor portion of the pair of guide portions, and the unlock position at which the lock shaft is detached from the anchor portion; the slide member having an engaging portion; and a lock member detachably constituted in the engaging portion of the slide member to lock the slide member at the lock position by engaging the engaging portion of the slide member when the slide member is located at the lock position.

13. The product delivering device of the automatic vending machine according to claim 12, wherein the lock member is constituted rotatably between the engaging position for engaging the engaging portion of the slide member, and the detachment position for detaching from the engaging portion, and a pressing portion for sliding the slide member from the lock position to the unlock position by pressing the slide member when the lock member is rotated from the engaging position to the detachment position.

14. The product delivering device of the vending machine according claim 13, wherein the lock mechanism has a first energizing means for energizing the lock member to be rotated from the detachment position to the engaging position, so that the lock member is rotated from the open position to the closed position by pressing the opening and closing member when the opening and closing member is located at the open position and is rotated from the detachment position to the engaging position with the first energizing means.

15. The product to be sold of the automatic vending machine according to claim 13 or claim 14, wherein the means for supporting the product to be sold next has a member for supporting the product to be sold next. the member being constituted slidably between the allowing position and the inhibiting position and a connection portion having a female screw and being movable in a vertical direction for connecting the means for supporting the product to be sold next to the drive means; and the drive means has a drive source and a drive shaft having a male screw on the surface thereof which is constituted in such a manner that the drive shaft extends in a vertical direction and is movably provided in a vertical direction to be rotated and driven in a predetermined direction around an axial line with a drive source with the result that the drive shaft moves the member for supporting the product to be sold next toward the inhibiting position around an axial line with the drive source via a connection member which moves in a downward direction, and the drive shaft is further rotated and moved in a predetermined direction with the drive source after the means for supporting the product to be sold next comes into contact with the product to be sold so that the drive shaft is moved in an upward direction;

the first unlocking means has an unlocking member provided on the lower end of the drive shaft, and at the same time, connected to the lock member, and rotates the lock member from the engaging position to the detachment position along with an upward movement of the drive shaft.

16. The product delivering device of the vending machine according to claim 15, wherein the drive means further has a second energizing means for energizing the drive shaft in a downward direction, and the second energizing means is further rotated and driven in a predetermined direction with the drive force after the member for supporting the product to be sold next comes into contact with the sales product so that the second energizing means is compressed or pulled with the drive shaft which moves in an upward direction and the product to be sold is delivered with the result that the drive shaft is driven in a downward direction with a return force when the contact of the product to be sold with the member for supporting the product to be sold next is released.

17. The product delivering device according to any one claim of claims 7 through 16 further comprising instruction means which is operated for instructing the delivering of all the product accommodated in the product passage at one time and second unlocking means for unlocking the opening and closing means of the locking means.

* * * * *